US009550947B2

(12) United States Patent
Ryu et al.

(10) Patent No.: US 9,550,947 B2
(45) Date of Patent: Jan. 24, 2017

(54) HYDROCRACKING PROCESS OF HEAVY HYDROCARBON DISTILLATES USING SUPERCRITICAL SOLVENT

(75) Inventors: Jae Wook Ryu, Daejeon (KR); IL Yong Jeong, Seoul (KR); Gyung Rok Kim, Daejeon (KR); Sung Bum Park, Daejeon (KR); Do Woan Kim, Daejeon (KR); Eun Kyoung Kim, Daejeon (KR); Sun Choi, Daejeon (KR); Chang Ha Lee, Seoul (KR); Jae Hyuk Lee, Seoul (KR); Yo Han Kim, Seoul (KR)

(73) Assignees: SK INNOVATION CO., LTD, Seoul (KR); INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 225 days.

(21) Appl. No.: 13/977,370

(22) PCT Filed: Dec. 26, 2011

(86) PCT No.: PCT/KR2011/010096

§ 371 (c)(1),
(2), (4) Date: Jun. 28, 2013

(87) PCT Pub. No.: WO2012/091382

PCT Pub. Date: Jul. 5, 2012

(65) Prior Publication Data

US 2013/0284639 A1 Oct. 31, 2013

(30) Foreign Application Priority Data

Dec. 28, 2010 (KR) ..... 10-2010-0137084
Dec. 20, 2011 (KR) ..... 10-2011-0138122

(51) Int. Cl.
*C10G 47/34* (2006.01)
*C10G 49/20* (2006.01)
(Continued)

(52) U.S. Cl.
CPC ..... *C10G 47/34* (2013.01); *C10G 47/02* (2013.01); *C10G 47/12* (2013.01); *C10G 47/26* (2013.01);
(Continued)

(58) Field of Classification Search
CPC ..... C10G 47/12; C10G 47/26; C10G 47/34; C10G 49/20
See application file for complete search history.

(56) References Cited

U.S. PATENT DOCUMENTS 4,108,760 A * 8/1978 Williams et al. ..... 208/390
4,363,717 A * 12/1982 Pelrine et al. ..... 208/108
(Continued)

FOREIGN PATENT DOCUMENTS

CN 1307086 A 8/2001
JP 2008-297468 A 12/2008
(Continued)

OTHER PUBLICATIONS

WIPO 2012/091382 A3, Jul. 5, 2012, International Search Report, International Application No. PCT/KR2011/010096, "Hydrocracking Process of Heavy Hydrocarbon Distillates Using Supercritical Solvent."
(Continued)

*Primary Examiner* — Renee E Robinson
(74) *Attorney, Agent, or Firm* — Bracewell LLP; Brad Y. Chin

(57) ABSTRACT

Specific embodiments of the present invention provide a hydrocracking process for converting low value-added heavy hydrocarbon distillates into high value-added hydrocarbon distillates using a supercritical solvent as a medium.

15 Claims, 14 Drawing Sheets

(51) Int. Cl.
*C10G 47/26* (2006.01)
*C10G 47/02* (2006.01)
*C10G 47/12* (2006.01)

(52) U.S. Cl.
CPC ..... *C10G 49/20* (2013.01); *C10G 2300/1077* (2013.01); *C10G 2300/44* (2013.01)

(56) References Cited

U.S. PATENT DOCUMENTS 4,559,127 A 12/1985 Paspek, Jr. et al.
4,585,546 A * 4/1986 Bowes et al. ..... 208/253
4,740,294 A * 4/1988 Rhodes ..... 208/413
4,810,364 A * 3/1989 Shaw ..... 208/254 H
5,496,464 A * 3/1996 Piskorz ..... B01J 3/008 208/108
6,251,822 B1 * 6/2001 Peng ..... B01J 21/18 502/423
2010/0294698 A1 * 11/2010 e Mello ..... C10G 25/12 208/210
2011/0049010 A1 * 3/2011 Abdel-Halim et al. ..... 208/59

FOREIGN PATENT DOCUMENTS

KR 0141884 B1 6/1998
KR 10-2009-0100423 A 9/2009
KR 10-2010-0107459 A 10/2010

OTHER PUBLICATIONS

CN 2011800636134 Office Action dated Apr. 24, 2014; 8pgs.
KR10-2011-0138122 Office Action dated Aug. 30, 2015; 7 pgs.
Chunbao (Charles) Xu, et al.; Hydro-treating of Asphaltenes in Supercritical Toluene with MgO-Supported Fe, Ni, NiMo, and CoMo Catalysts; Energy & Fuels 2009; vol. 23, pp. 3645 & 3651; 2 pgs.

* cited by examiner

HYDROCRACKING PROCESS OF HEAVY HYDROCARBON DISTILLATES USING SUPERCRITICAL SOLVENT

RELATED APPLICATION

This application is related to, and claims priority to, PCT Patent Application No. PCT/KR2011/010096, filed on Dec. 26, 2011, which claims priority to Korean Patent Application Serial Nos. 10-2010-0137084, filed on Dec. 28, 2010, and 10-2011-0138122, filed on Dec. 20, 2011, the disclosures of which are incorporated herein by reference in their entirety.

BACKGROUND

Field of the Invention

The present invention relates to a hydrocracking process of heavy hydrocarbon distillates using a supercritical solvent, and, more particularly, to a hydrocracking process for converting low value-added heavy hydrocarbon distillates into high value-added hydrocarbon distillates using a supercritical solvent as a medium.

Description of the Related Art

Recently, demands for transport oils, particularly, light oil products, have continuously increased, whereas demands for heavy oil products, such as bunker oil and the like, have decreased. However, the ratio of high-sulfur crude oil and heavy crude oil to produced crude oils has gradually increased compared to in the past. Moreover, according to concerns about petroleum resource exhaustion, it has been continuously required to develop technologies for upgrading low-priced heavy hydrocarbon distillates, such as heavy distillates obtained during a crude oil refining process, bitumen (an alternative to crude oil) and the like, to produce high value-added light oil products and petrochemical raw material distillates.

As a typical example of such low-grade heavy distillates, there is a vacuum residue which is an oil distillate recovered from the bottom of a reduced-pressure distillation tower during a crude oil refining process (e.g., the vacuum residue is obtained at a pressure of 25 to 100 mmHg, and has a boiling point of about 813.15 K or more at atmospheric pressure). Because such low-grade heavy distillates have low H/C ratios and high viscosity, they are difficult to upgrade. Further, typically, heavy distillates, particularly, a vacuum residue, have high contents of sulfur, nitrogen, oxygen and heavy metals (e.g., vanadium, nickel, iron and the like) as well as polyaromatic compounds, such as asphaltene and the like.

In relation to this, various methods of upgrading heavy hydrocarbon distillates have been proposed. One of these methods includes a process for converting low value-added heavy hydrocarbon distillates having a high boiling point into high value-added hydrocarbon distillates having a low boiling point.

Conventional examples of the above-mentioned converting process include, for example, cracking, hydrocracking, catalytic cracking, steam cracking and the like. However, this converting process generally requires extreme operation conditions of high temperature, high hydrogen pressure and the like, and uses a hydrogenation catalyst having a weak acidic support to prevent the formation of coke. In relation to this, a vacuum residue is known to have hydrocracking characteristics different from those of light oil.

Meanwhile, recently, processes of treating and upgrading crude oil or heavy distillates in a supercritical medium or solvent have been developed. For example, Korean Unexamined Patent Application Publication No. 2010-0107459 describes a process for recovering an oil distillate having a low content of asphaltene, sulfur, nitrogen or a metal as well as having a low heavy component content by bringing heavy distillates stream into contact with supercritical water to convert the heavy distillates into refined heavy distillates; Japanese Unexamined Patent Application Publication No. 2008-297468 describes a process for decomposing heavy distillates under the supercritical condition of a saturated hydrocarbon solvent (e.g., dodecane, normal hexane, cyclohexane and the like); and U.S. Pat. No. 4,559,127 describes a process for converting a high-boiling hydrocarbon distillate, such as a vacuum residue, into a low-boiling hydrocarbon distillate using halogen or hydrogen halide as a catalyst under the supercritical condition of an acidic aqueous solution medium.

Most commonly-known processes are processes of converting heavy hydrocarbon distillates into low-boiling hydrocarbon distillates using water or a saturated hydrocarbon solvent as a supercritical medium in the presence of a catalyst. In this case, as typical examples of high value-added oil distillates that can be obtained from an upgrading process, there are naphtha (IBP to 177° C.) and a middle distillate (177 to 343° C.). Particularly, a middle distillate has been attracting considerable attention recently, in accordance with the increase in demands for aviation oil and diesel oil (light oil), because it includes kerosene and diesel oil in an oil refining process. However, when a conventional supercritical solvent is used, the conversion of a low value-added oil distillate into a high value-added distillate (particularly, a middle distillate as a raw material of diesel oil) is insufficient, requiring improvement of the conventional supercritical solvent to prevent the formation of coke.

Moreover, the conventional technology is disadvantageous in that the composition of the converted oil distillate is greatly changed depending on hydrogen pressure. For this reason, there is a problem in that a reaction of converting heavy distillates into high value-added oil distillates, such as a middle distillate (and/or naphtha), must be conducted under relatively high partial pressure of hydrogen.

Therefore, it is required to develop a hydrocracking process for heavy hydrocarbon distillates using a supercritical solvent, which can reduce the formation of coke even under the condition of low hydrogen pressure compared to that of a conventional technology, which can maintain a high conversion ratio and which can improve the selectivity of a middle distillate, the demand for which has recently increased.

SUMMARY

Embodiments of the present invention provide a process for converting low value-added heavy hydrocarbon distillates into high value-added hydrocarbon distillates using a supercritical solvent as a medium.

In accordance with an embodiment of the invention, there is provided a method of converting a heavy hydrocarbon distillate into a low-boiling hydrocarbon. The method includes the step of contacting a heavy hydrocarbon distillate with a supercritical xylene-containing solvent in the presence of a hydrogenation catalyst to hydrogenate the heavy hydrocarbon distillate for converting the heavy hydrocarbon distillate into the low-boiling hydrocarbon.

In accordance with another embodiment of the invention, the hydrogenation of the heavy hydrocarbon distillate is performed at a hydrogen pressure of 30 to 150 bars.

In accordance with another embodiment of the invention, the supercritical xylene-containing solvent is an aromatic solvent containing at least 25 wt % of m-xylene.

In accordance with another embodiment of the invention, the supercritical xylene-containing solvent includes (i) 70 to 85 wt % of xylene, (ii) 15 to 25 wt % of ethylbenzene, and (iii) 5 wt % of toluene or a C9+ aromatic.

In accordance with another embodiment of the invention, the heavy hydrocarbon distillate is a vacuum residue.

In accordance with another embodiment of the invention, a weight ratio of the supercritical xylene-containing solvent to the heavy hydrocarbon distillate (xylene-containing solvent/heavy hydrocarbon distillate) is 3 to 10.

In accordance with another embodiment of the invention, the hydrogenation of the heavy hydrocarbon distillate is performed at a temperature of 350° C. to 420° C. and a hydrogen pressure of 30 to 100 bars.

In accordance with another embodiment of the invention, the hydrogenation catalyst includes one of a metal-based catalyst or and an active carbon catalyst.

In accordance with another embodiment of the invention, the metal-base catalyst includes Mo, W, Co, Ni or a combination thereof.

In accordance with another embodiment of the invention, the active carbon catalyst is an acid-treated active carbon catalyst.

In accordance with another embodiment of the invention, the active carbon catalyst includes 0.1 to 30 At % of a cocatalyst containing at least one metal selected from the group consisting of IA group metals, VIIB group metals, and VIII group metals.

In accordance with another embodiment of the invention, the at least one metal included in the cocatalyst is lithium (Li), nickel (Ni), iron (Fe), or a combination thereof.

In accordance with another embodiment of the invention, the active carbon catalyst includes 5 to 15 wt % of the cocatalyst.

In accordance with another embodiment of the invention, the low-boiling hydrocarbon includes comprises a middle distillate.

In accordance with another embodiment of the invention, the active carbon catalyst is a petroleum pitch-derived active carbon.

In accordance with another embodiment of the invention, there is provided a method of converting a heavy hydrocarbon distillate into a low-boiling hydrocarbon. The method includes the steps of introducing a heavy hydrocarbon distillate into a reaction zone, and hydrogenating the heavy hydrocarbon distillate in the presence of a supercritical xylene-containing solvent and a catalyst to obtain a hydrogenation reaction product. The method further includes transferring the hydrogenation reaction product to a fractionator to separate and recover a low-boiling target hydrocarbon distillate, and transferring non-separated and non-recovered components to an extractor to separate these components into recycle components and discharge components. Further, the method includes transferring the recycle components to the reaction zone.

In accordance with another embodiment of the invention, the xylene-containing solvent includes at least 25 wt % of xylene, the hydrogenation of the heavy hydrocarbon distillate is performed at a hydrogen pressure of 30 to 150 bars, and the recycle components include xylene.

In accordance with another embodiment of the invention, the discharge components include coke and a waste catalyst.

In accordance with another embodiment of the invention, the method further includes the steps of regenerating the waste catalyst and recycling a portion of the regenerated waste catalyst for the hydrogenating step.

BRIEF DESCRIPTION OF THE DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

Figure 1:
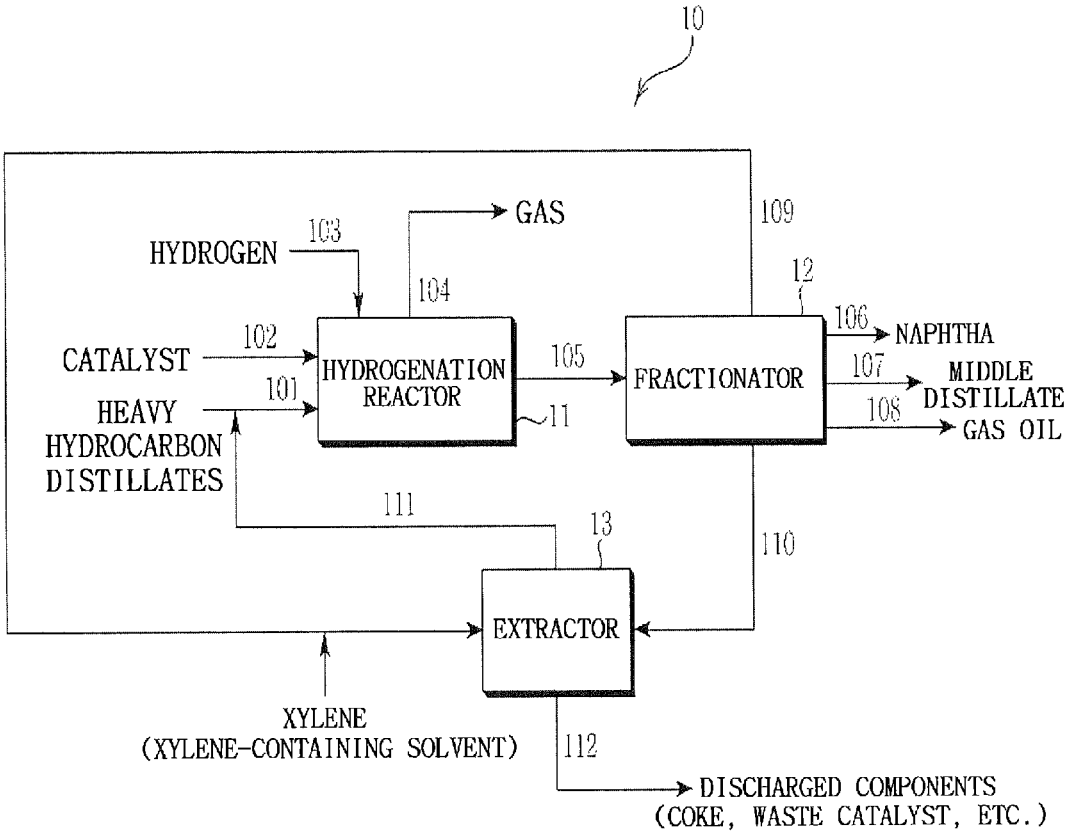
FIG. 1 is a schematic diagram showing a process for hydrotreating heavy hydrocarbon distillates in a supercritical medium, in accordance with an embodiment of the invention.

Although the following detailed description contains many specific details for purposes of illustration, it is understood that one of ordinary skill in the relevant art will appreciate that many examples, variations, and alterations to the following details are within the scope and spirit of the invention. Accordingly, the exemplary embodiments of the invention described herein are set forth without any loss of generality, and without imposing limitations, relating to the claimed invention.

Feed

In an embodiment of the present invention, a heavy hydrocarbon distillate, corresponding to a feed, includes a hydrocarbon distillate having a boiling point of 360° C. or more (more typically, a boiling point of 530° C. or more), and, more specifically, includes a hydrocarbon distillate from which asphalt is removed (for example, solvent deasphaltene (SDA)), and which has a boiling point of 360° C. or more (more typically, a boiling point of 530° C. or more). In accordance with at least one embodiment, the feed includes, for example, crude oil, an atmospheric residue, a vacuum residue, a hydrogenation residue, sand oil, and the like. In accordance with one embodiment, the feed is a vacuum residue. In this case, the boiling point of the feed is an initial boiling point (IBP) or a 5% distillation point.

However, it will be understood that in accordance with various embodiments of the invention, the "heavy hydrocarbon distillate" partially includes a distillate having a boiling point of about 360° C. or lower, or includes a material partially insoluble in a xylene-containing solvent, and this distillate can be used as the feed.

As described above, various embodiments of the invention provide a process for converting a heavy hydrocarbon distillate into a low-boiling hydrocarbon distillate under supercritical conditions of higher than a critical temperature and pressure of a specific solvent.

Solvent

Generally, in a supercritical state, a solvent behaves as a liquid phase similar to a gas, so a viscosity of the solvent is remarkably lowered, thereby improving transport characteristics thereof. In the supercritical state, a diffusion speed of particles in pores of a catalyst, and thus a limitation of mass transfer and a formation of coke, can be minimized. Further, in the supercritical state, a solvent has an excellent ability of dissolving a heavy intermediate, which is a tar forming precursor, and exhibits excellent hydrogen shuttling ability.

In accordance with an embodiment of the invention, heavy hydrocarbon distillates are converted into low-boiling hydrocarbon distillates using a solvent containing xylene. Comparing xylene with another aromatic solvent, for example, toluene, it is determined that xylene is a component having greater steric hindrance than that of toluene, but the effects of such steric hindrance and hydrodynamic resistance are not considered as important factors under a supercritical condition.

On the contrary, xylene, particularly, m-xylene acts as a strong hydrogen donor compared to other alkane solvents or toluene at the time of treating heavy distillates under a supercritical condition. Further, xylene is advantageous in that it has a high conversion ratio of heavy hydrocarbon distillates into low-boiling hydrocarbon distillates and high selectivity of high value-added low-boiling distillates at a low pressure of about 100 kg/cm$^2$ (generally, heavy oil refining pressure >about 150 kg/cm$^2$) and at a temperature range of 350° C. to 420° C. at which a supercritical condition is formed. In particular, when the hydrocracking reaction of heavy distillates are conducted in a supercritical xylene-containing solvent, it can be ascertained, in accordance with various embodiments of the invention, that a yield of a middle distillate (e.g., a raw material of diesel oil) is remarkably increased compared to when a commonly-known solvent (e.g., n-hexane, dodecane, toluene, and the like) is used.

In accordance with at least one embodiment, since xylene, preferably, an aromatic solvent containing m-xylene, is used as a reaction medium, an amount of xylene in the solvent can be determined in consideration of several factors, for example, dissolving power for heavy distillates (particularly, asphaltene), degree of formation of coke, conversion ratio, and the like. In accordance with an embodiment, the amount of xylene in the solvent may be 25 wt % or more, 30 wt % or more in another embodiment, and 50 wt % or more in another embodiment of the invention. Further, if necessary, a pure xylene solvent may be used as the reaction medium. In accordance with an embodiment, when the xylene-containing aromatic solvent is used as a reaction medium, this solvent includes aromatic components other than xylene. The aromatic components include, for example, ethylbenzene, toluene, C9+ aromatic, and mixtures thereof. In accordance with at least one embodiment, an applicable solvent composition includes (i) 70 to 85 wt % of xylene, (ii) 15 to 25 wt % of ethylbenzene, and (iii) about 5 wt % of toluene or C9+ aromatic. Further, in accordance with another embodiment, a naphtha distillate produced during a reaction includes components having a boiling point similar to that (about 137° C.) of xylene as a supercritical medium Therefore, if necessary, a predetermined amount of xylene may be replenished in order to maintain the concentration of xylene in the xylene-containing solvent at a predetermined level.

In an embodiment of the present invention, a weight ratio of the xylene-containing solvent to the heavy hydrocarbon distillate (e.g., xylene-containing solvent/heavy hydrocarbon) is 0.5 to 15, 3 to 10 in accordance with another embodiment, and 5 to 8 in accordance with another embodiment.

Catalyst

According to an embodiment of the invention, the hydrocracking reaction of heavy distillates using xylene as a medium is performed in the presence of a catalyst. In accordance with at least one embodiment, the catalyst includes an acid-treated active carbon catalyst having an acidic surface. The physical properties of the exemplified active carbon are shown in Table 1 below, and the present invention is not limited thereto.

TABLE 1

| Properties | Values |
|---|---|
| Specific surface area (BET: $m^2/g$) | 800~1500, preferably 1000~1300 |
| Micropore area (DR method: $m^2/g$) | 900~1400, preferably 1000~1300 |
| Micropore volume (DR method: $m^3/g$) | 0.3~0.7, preferably 0.4~0.6 |
| Average micropore diameter (nm) | 0.8~1, preferably 0.85~0.95 |
| Mesopore area (BJH absorption: $m^2/g$) | 100~400, preferably 150~300 |
| Mesopore volume (BJH absorption: $m^3/g$) | 0.15~0.4, preferably 0.2~0.35 |
| Average mesopore diameter (nm) | 2.1~4, preferably 2.4~3.5 |

The active carbon can be obtained from various sources. In accordance with certain embodiments, the active carbon includes, for example, bituminous coal-derived active carbon, petroleum pitch-derived active carbon, and the like. In order to increase the conversion ratio of heavy distillates into light distillates and prevent the formation of coke during a process of hydrocracking heavy distillates, such as a vacuum residue and the like, specific surface area and volume of mesopores are considered as important factors. Although the various embodiments of the invention are not restricted to specific theories, the reason for the increased conversion ratio is presumed that the mesopores of active carbon enable free radicals of hydrocarbons initially produced from asphaltene to be easily diffused, provide adsorption sites for inhibiting polymerization or condensation, and enable asphaltene micelles and aggregates to come close to catalytic active sites, thereby preventing the formation of coke and effectively producing light oil distillate.

In particular, when xylene (particularly, m-xylene) is used as a solvent, it is presumed that xylene contributes to the diffusion of heavy distillates into the mesopores of active carbon in a supercritical state. Therefore, it is determined that, in the hydrocracking reaction of heavy distillates using a supercritical xylene, the influence of physical properties of micropores upon the reaction is relatively small. In this respect, petroleum pitch-derived active carbon may be more advantageous, but the various embodiments of the invention are not limited thereto.

Meanwhile, according to an embodiment of the present invention, the active carbon catalyst includes an acid-treated active carbon catalyst. The acid includes, for example, at least one of an inorganic acid (e.g., hydrochloric acid, phosphoric acid, sulfuric acid, nitric acid, and the like) and an organic acid (e.g., formic acid, acetic acid, and the like). In accordance with one embodiment, the acid includes an inorganic acid. In accordance with another embodiment, the acid includes sulfuric acid. In this latter case, the total acidity of the acid-treated active carbon catalyst is 0.1 to 3, 0.13 to 2.5 in another embodiment, and 0.15 to 2 in another embodiment, but various embodiments of the present invention are not limited thereto.

According to an embodiment of the present invention, in order to increase the conversion ratio of a heavy distillate into a light distillate or change the yield of a product (for example, in order to convert a part of a middle distillate into naphtha due to a change in market demand of naphtha even when the production of a middle distillate is maximized), a metal cocatalyst (e.g., an additive) is added to the active carbon catalyst. In the case of the hydrocracking reaction of heavy distillates in a supercritical xylene-containing medium, the yield of a middle distillate (i.e., which is used as a raw material of diesel oil) in a light distillate is high. In relation to this, the ratio of naphtha in the light distillate produced by the hydrocracking reaction of the heavy distillate in the supercritical xylene-containing medium can be increased at a predetermined level by adding the metal cocatalyst to the active carbon catalyst.

The metal cocatalyst includes, for example, any one selected from the IA group metals (e.g., alkali metals), VIIB group metals, VIII group metals, and combinations thereof. In accordance with at least one embodiment, the metal cocatalyst includes, for example, iron, nickel, lithium, or a combination thereof. This metal cocatalyst exists in the form of $Fe_2O_3$, $NiSO_4$ or $C_2H_3O_2Li$. Although the various embodiments of the invention are not restricted to specific theories, it is presumed that the cocatalyst serves to accelerate the conversion of a part of a middle distillate into naphtha. Further, this cocatalyst is more effective in the hydrocracking reaction of a heavy distillate in a supercritical xylene medium using an acid-treated active carbon catalyst.

In an embodiment of the present invention, the cocatalyst is used in an amount of 0.1 to 30 wt %, 1 to 20 wt % in another embodiment, and 5 to 15 wt % in another embodiment, based on the total weight of the active carbon catalyst.

In addition to the above-mentioned active carbon catalyst, various metal-based catalysts, which have been previously used in a process of hydrorefining a heavy distillate, are used as the catalyst, in accordance with certain embodiments of the invention. Here, the metal-based catalyst includes, for example, Mo, W, V, Cr, Co, Fe, Ni, or a combination thereof, Mo, W, Co, Ni, or a combination thereof in other embodiments, and Co—Mo or Ni—Mo in other embodiments. The metal-based catalyst exists in the form of a metal element or a sulfide thereof. Therefore, even when the metal-based catalyst exists in the form of a metal element, its surface exists in the form of a sulfide of the metal element due to the sulfur compound included in a heavy distillate.

In accordance with at least one embodiment, the metal-based catalyst is supported in a carrier. The carrier includes, for example, inorganic oxides, such as alumina, silica, silica-alumina, zirconia, titania, magnesium oxide, and combinations thereof. The carrier has a specific surface area (BET) of 100 to 500 $m^2/g$, preferably, 150 to 300 $m^2/g$ in at least one embodiment, and a pore size of 1 to 20 nm, preferably, 3 to 10 nm in another embodiment.

In the metal-based catalyst supported in a carrier, the metal-based catalyst includes, for example without limitation, the metal in an amount of 5 to 30 wt % in accordance with an embodiment of the invention, 10 to 25 wt % in another embodiment, and 15 to 20 wt % in another embodiment, based on the total weight thereof.

Hydrogenation (Hydrotreatment) Conditions

According to an embodiment of the present invention, heavy hydrocarbon distillates are hydrogenated (hydrotreated) under the supercritical condition (state) of a xylene-containing solvent (medium). In order to enable a heavy distillate to be easily converted, prior to hydrotreatment, a mixing process for increasing the contact between a heavy distillate and a xylene-containing solvent is selectively performed. For this purpose, a mixture may be ultrasonically treated.

As described above, the hydrogenation (hydrotreatment) of a heavy hydrocarbon distillate, in accordance with at least one embodiment, is performed under the supercritical condition (i.e., temperature and pressure of a critical point or higher) of a xylene-containing solvent (i.e., medium). In the case of xylene, particularly, m-xylene, its critical temperature (Tc) and critical pressure (Pc) are 344.2° C. and 35.36 bar (3.536 MPa), respectively, but the critical temperature and critical pressure of a mixed solvent of xylene and another aromatic solvent can be changed. Further, since similar effects are exhibited even near critical conditions, the total pressure of the hydrogenation (hydrotreatment) system can be controlled in consideration of these effects.

The process according to an embodiment of the invention is performed at a wide hydrogen pressure range of 30 bar (3 MPa) or more. Various embodiments of the invention provide a process that provides non-obvious advantageous over conventional hydrotreatment processes. Because a xylene-containing solvent is used, a heavy hydrocarbon distillate can be converted into a high value-added distillate at relatively low hydrogen pressure compared to when a different solvent is used. In accordance with some embodiments, hydrogen pressure (e.g., partial pressure) is set in a range of 30 to 150 bar (3 to 15 MPa), and 30 to 100 bar (3 to 10 MPa) in other embodiments of the invention. Various embodiments provide a hydrogen partial pressure that is 88 to 95% of the total pressure of a typical hydrotreatment (hydrogenation) system.

Further, in accordance with some embodiments, the hydrogenation temperature is set in a range of 420° C. or lower, 350 to 410° C. in other embodiments, and 370 to 400° C. in other embodiments to prevent overcracking and minimize the formation of coke. If necessary, it is preferred that the condition of the hydrogenation reaction be adjusted such that a reaction product is present in a supercritical state.

According to an embodiment of the present invention, the hydrotreatment reaction time (or residence time) is 0.5 to 6 hours, and 1 to 3 hours in another embodiment. Further, the hydrotreatment reaction is performed using one of a fixed-bed reactor, an ebullating reactor, or a slurry reactor.

When the hydrotreatment reaction, in accordance with various embodiments, is performed in the presence of a hydrogenation catalyst using a supercritical xylene-containing solvent as a medium, hydrogen shuttling effects are caused. The reason for this is determined that hydrogen and a heavy hydrocarbon distillate, which are reactants, are converted from two phases to a single phase under the supercritical condition of a medium, and thus the hydrogen transfer speed toward a catalyst is rapidly increased.

As described above, the reaction products obtained by the hydrotreatment of a heavy hydrocarbon distillate include, for example, distillates that can be used as a solvent or medium for hydrotreatment; distillates, such as a middle distillate, naphtha, gas oil, and the like; residues (e.g., residues containing coke, catalyst, and the like); and various gaseous compounds (e.g., $H_2S$, $NH_3$, CO., $CH_4$, and the like). The physical properties, particularly, 95% boiling point of the liquid reaction product may be changed depending on the kind of heavy hydrocarbon distillate used as a feed. For example, the 95% boiling point thereof may be 350 to 550° C.

Further, in accordance with at least one embodiment, the hydrogenation reaction products are characterized in that the amounts of sulfur and nitrogen, as well as metal, are remarkably reduced.

In order to obtain desired (i.e., target) distillates (e.g., light distillates such as naphtha, a middle distillate, particularly, a middle distillate, and the like), the reaction products are phase-separated or separated according to boiling point in a fractionator. In this case, the pressure in the fractionator is set such that the temperature of the high-temperature region located at the lower end of the fractionator does not exceed 360° C. in consideration of the boiling point of distillates to be separated. In this case, the pressure in the fractionator is 0.01 to 5 bar (0.001 to 0.5 MPa). In accordance with certain embodiments, the fractionator includes, for example, packing-type and tray-type distillation columns, and includes a reboiler and a condenser in other embodiments.

In accordance with embodiments of the invention, desired middle distillates, particularly, high value-added distillates, such as naphtha and the like, are recovered from the fractionator with respect to each boiling point. Further, solvents suitable for hydrotreatment are recovered from the fractionator, and these recovered solvents are reused in hydrotreatment.

In an embodiment of the present invention, the distillates recovered from the fractionator are additionally treated. For example, the recovered middle distillate can be used to prepare diesel oil, jet oil, and the like, and the recovered naphtha, which can suffer from a catalytic refining reaction, can be used to prepare gasoline. In accordance with at least one embodiment, the recovered gas oil is reused as a feed of a catalytic cracking reaction or a hydrocracking reaction.

Coke and waste catalyst included in the residues recovered from the fractionator are solids, and are separated and removed by conventional methods, and, if necessary, a waste catalyst is regenerated or partially recycled to be used in a hydrogenation reaction.

FIG. 1 is a schematic diagram showing a process for hydrotreating a heavy hydrocarbon distillate in a supercritical medium, in accordance with an embodiment of the invention.

As shown in FIG. 1, the process 10, according to various embodiments of the invention, includes a hydrogenation reactor 11, a fractionator 12, and an extractor 13, wherein a solvent is used as both a supercritical medium and a coke extraction solvent.

In accordance with at least one embodiment, the temperature and pressure in the hydrogenation reactor 11 is controlled, such that a hydrogenation reaction takes place in the supercritical state of a xylene-containing solvent. In this case, as described above, the total pressure in the hydrogenation reactor 11 is controlled such that the hydrogen pressure (e.g., partial pressure) is 30 to 150 bar (3 to 15 MPa) in accordance with certain embodiments, and 30 to 100 bar (3 to 100 MPa) in other embodiments, and the temperature in the hydrogenation reactor 11 is controlled in the range of 350 to 420° C., in accordance with certain embodiments, and 370 to 400° C. in other embodiments.

The hydrogenation reactor 11 is provided with inlet ports (not shown) for respectively introducing a heavy hydrocarbon distillate (and/or a medium) and hydrogen, and is provided with outlet ports (not shown) for respectively discharging a hydrogenation reaction product, a xylene-containing solvent (medium), and gas components generated by a hydrogenation reaction. In accordance with embodiments of the invention, the hydrogenation reactor 11 includes, for example, a slurry type reactor, an ebullating reactor and the like, but is not limited thereto.

In accordance with at least one embodiment, after the hydrogenation reaction (i.e., hydrotreatment), a xylene-containing solvent is recycled from the extractor 13 through a line 111 to be mixed with a heavy hydrocarbon distillate (i.e., feed), and a mixture of the xylene-containing solvent and the heavy hydrocarbon distillate is introduced into the hydrogenation reactor 11 through a line 101. In this case, the mixing ratio of the xylene-containing solvent to the heavy hydrocarbon distillate (i.e., solvent/heavy hydrocarbon distillate by weight) is adjusted in the range of 0.5 to 15, as a non-limiting example.

As further shown in FIG. 1, hydrogen is introduced into the hydrogenation reactor 11 through a hydrogen supply line 103, and, in accordance with at least one embodiment, is supplied in the form of hydrogen molecules.

In accordance with certain embodiments, a hydrogenation catalyst is introduced into the hydrogenation reactor 11 through a line 102 in the form of a particle (e.g., filling up type or flowing type) or a colloid in which catalyst particles are dispersed in xylene (or xylene-containing solvent.

In accordance with certain embodiments, the residence time of a mixture of a heavy hydrocarbon distillate and a xylene-containing solvent in the hydrogenation reactor 11 is not particularly limited as long as the heavy hydrocarbon distillate is sufficiently upgraded by a hydrogenation reaction. For example, in accordance with at least one embodiment, the residence time thereof is 0.5 to 6 hours, and 1 to 3 hours in at least one other embodiment.

As a hydrogenation reaction proceeds, a heavy hydrocarbon distillate is converted into a low-boiling hydrocarbon distillate under the supercritical condition of a medium, and simultaneously gaseous components (e.g., $H_2S$, $NH_3$, $CO_2$, $CH_4$, and the like) are produced. As shown in FIG. 1, the gaseous components are discharged to the outside from a gas discharge outlet port provided in the hydrogenation reactor 11 through a line 104.

As further shown in FIG. 1, the hydrogenation reaction product (including a low-boiling hydrocarbon distillate and medium components) is discharged from the hydrogenation reactor 11 through an outlet port (not shown), and then transferred to a fractionator 12, through a line 105. In the fractionator 12, the hydrogenation reaction product is separated into naphtha 106, a middle distillate 107, and gas oil 108, according to boiling point. Medium components discharged together with the naphtha 106 are separated from the naphtha 106, and then transferred to an extractor 13 through a line 109. In accordance with certain embodiments, the medium components transferred to the extractor 13 include, for example, naphtha components having boiling points similar to those of the medium components, and the separated and recovered naphtha 106 includes, for example, a small amount of xylene. Further, during the procedure of transferring the medium components to the extractor 13, insufficient medium components, for example, xylene or a xylene-containing solvent, may be replenished.

In accordance with various embodiments, residual components in the fractionator 12, that is, residues include, for example, hydrogenated distillates, medium components and the like, and coke (and waste catalyst) produced by the hydrogenation reaction. For this reason, in an embodiment of the present invention, residues are discharged by a bottom stream from the fractionator 12, and then transferred to the extractor 13 through a line 110. The residues transferred to the extractor 13 are separated into recycle components (mainly, xylene-containing solvent) and discharge components (mainly, coke, and solid components including waste catalyst) by the extractor 13. The method of separating residues in the extractor 13 is not particularly limited, but may be similar to a solvent deasphaltene (SDA) process.

In this case, as described above, the recycle components are mixed with a heavy hydrocarbon distillate (feed) through the line 111. The discharge components are discharged from the extractor 13 through the line 112, and then discarded. If necessary, among the discharge components, a waste catalyst is regenerated, and then entirely or partially supplied to the hydrogenation reactor 11.

Hereinafter, embodiments of the present invention will be described in more detail with reference to the following Example. This Example is set forth to illustrate various embodiments of the present invention, and the scope of the present invention is not limited thereto.

Example 1

Sample

Figure 2:
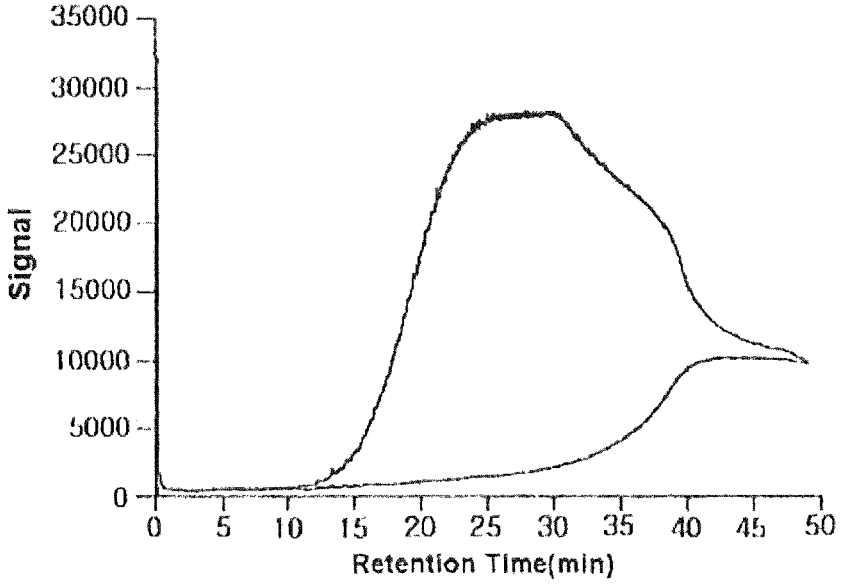
FIG. 2 is a graph showing results of analyzing a vacuum residue using a high-temperature SIMIDID of ASTM, in accordance with an embodiment of the invention.
Figure 3:
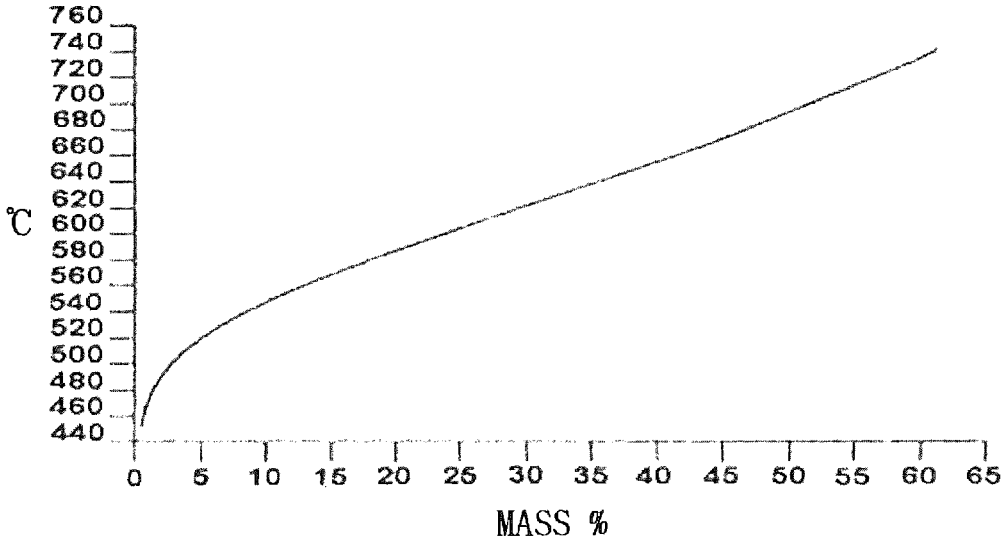
FIG. 3 is a graph showing distribution characteristics of the boiling point of the vacuum residue, in accordance with an embodiment of the present invention.

In Example 1, a vacuum residue provided from a commonly-used process was used as a sample of a heavy hydrocarbon distillate. The sample was analyzed by the ASTM high-temperature SIMDIS, and the results thereof are shown in FIG. 2. The boiling point distribution characteristics of the sample are shown in FIG. 3.

As a result, the vacuum reside included 23.03 wt % or more of conradson carbon residue (CCR), and the amount of the vacuum residue that can be recovered at a high temperature of 750° C. was at most 62.6 wt %. Further, the vacuum residue included 96 wt % or more of pitch (i.e., boiling point: 524° C. or higher). The physical properties of the vacuum residue are shown in Table 2 below.

TABLE 2

| | |
|---|---|
| CCR (wt %) | 23.03 |
| S (wt %) | 5.32 |
| N (wt %) | 0.289 |
| Ni (wppm) | 38.4 |
| V (wppm) | 104.2 |
| Fe (wppm) | 23.2 |
| Viscosity (cSt, 100° C.) | 3,580 |
| Cut point (wt %) | |
| naphtha | — |
| middle distillate | — |
| gas oil | 5.8 |
| residue (525~750° C.) | 56.8 |

As shown in Table 2 above, it can be ascertained that the viscosity of the vacuum residue is very high, and that the vacuum residue includes 5.32 wt % of sulfur and 0.289 wt % of nitrogen, that is, includes a large amount of sulfur and a large amount of nitrogen.

Solvent n-hexane, n-dodecane and toluene were used as comparative solvents, and m-xylene was used as the solvent for various embodiments of the present invention. All four solvents were commercially available from Sigma Aldrich Co. Ltd. (CHROMASOLV®-HPLC-grade). The physical properties of the four solvents are shown in Table 3 below. For reference, the physical properties of o-xylene, p-xylene and ethylbenzene are also shown in Table 3 below.

TABLE 3

| Solvent | Density | Boiling point (° C.) | Tc (° C.) | Pc (MPa) |
|---|---|---|---|---|
| n-hexane | 0.659 | 69 | 234.5 | 3.020 |
| n-dodecane | 0.748 | 216.4 | 385.2 | 1.8 |
| toluene | 0.865 | 110.7 | 318.7 | 4.1 |
| m-xylene | 0.864 | 137 | 344.2 | 3.536 |
| o-xylene | 0.880 | 144.4 | 357.2 | 3.730 |
| p-xylene | 0.861 | 138.4 | 343.1 | 3.511 |
| Ethylbenzene | 0.867 | 136.2 | 343.1 | 3.701 |

Hydrogen Gas

Hydrogen gas (i.e., high-purity hydrogen having a purity of 99.999%) was pressurized using a high pressure controller (e.g., H-YR-5062) having a partition pressure range of 0~15 MPa.

Catalyst

In Example 1, in order to prepare a catalyst, two types of commonly-used active carbons, for example, granulous bituminous coal-derived active carbon (CALGON FILTRASORB 300®; Calgon Carbon Corporation) and spherical petroleum pitch-derived active carbon (A-BAC LP®, Kureha Corporation) were used.

Further, each of the two types of active carbons was treated with sulfuric acid to increase the number of acid sites (or the concentration of functional groups) on the surface thereof. Ash was removed from the active carbon using concentrated hydrochloric acid and hydrofluoric acid, and then the active carbon was dried at a temperature of 120° C. for one night using an air oven. Thereafter, the dried active carbon was chemically modified with concentrated sulfuric acid (e.g., 96 wt %) in a flask provided with a water reflux condenser at a temperature of 250° C. for 3 hours. Subsequently, the chemically-modified active carbon was completely washed with deionized distilled water (i.e., until this active carbon no longer included sulfate), and then dried at 120° C. for one night. Thereafter, this active carbon was recycled by a Soxhlet procedure using toluene as a solvent.

The properties of the active carbons and the active carbons modified with acid treatment are shown in Table 4 below:

TABLE 4

| | A | B | C | D |
|---|---|---|---|---|
| Specific surface area (BET: $m^2/g$) | 1025.17 | 1216.01 | 1119.81 | 1193.42 |
| Micropore area (DR method: $m^2/g$) | 1055.59 | 1247.03 | 1088.18 | 1150.50 |
| Mesopore area (BJH absorption: $m^2/g$) | 193.81 | 213.72 | 200.81 | 259.68 |
| Micropore volume (DR method: $cm^3/g$) | 0.46 | 0.52 | 0.47 | 0.52 |
| Mesopore volume (BJH absorption: $cm^3/g$) | 0.23 | 0.29 | 0.25 | 0.30 |
| Average micropore diameter (nm) | 0.903 | 0.926 | 0.871 | 0.871 |
| Average mesopore diameter (nm) | 3.187 | 3.431 | 2.749 | 2.468 |
| Surface acidity (meq/g) | | | | |
| Phenol | 0.026 | 0.425 | 0.021 | 0.416 |
| Lactone | 0.047 | 0.396 | 0.038 | 0.391 |
| Carboxyl | 0.051 | 0.913 | 0.054 | 0.926 |
| Total acidity | 0.124 | 1.834 | 0.113 | 1.733 |
| Total basicity | 0.475 | 0.002 | 0.416 | 0.003 |

A: granulous active carbon (bituminous coal-derived active carbon, CALGON FILTRASORB 300 ®)
B: granulous catalyst modified with sulfuric acid (e.g., 96 wt %)
C: spherical active carbon (petroleum pitch-derived active carbon, A-BAC LP ®)
D: spherical catalyst modified with sulfuric acid (e.g, 96 wt %)

As shown in Table 4 above, the catalyst C had a large micropore area, mesopore area, micropore volume, and mesopore volume compared to those of the catalyst A. Therefore, it can be ascertained that the mesopore size and micropore size of the catalyst C are small compared to those of the catalyst A. Further, the acidity and basicity of the catalyst C were low compared to those of the catalyst A, except a carboxylic group. After the sulfuric acid treatment, the specific surface areas, pore volumes and surface acidities of the catalysts A to D were increased, and the pore diameter of the catalyst B was also increased. In contrast, the micropore diameter of the catalyst D was not changed, and, particularly, the mesopore diameter thereof was decreased (from 2.749 nm to 2.468 nm). The surface acidities of the catalyst B and D were similar to each other, but the total acidity of the catalyst B was somewhat high compared to that of the catalyst D. Therefore, it can be ascertained that, comparing the catalyst D with the catalyst B, only the mesopore area of the catalyst D is somewhat high compared to that of the catalyst B.

Test Apparatus and Test Method

Figure 4:
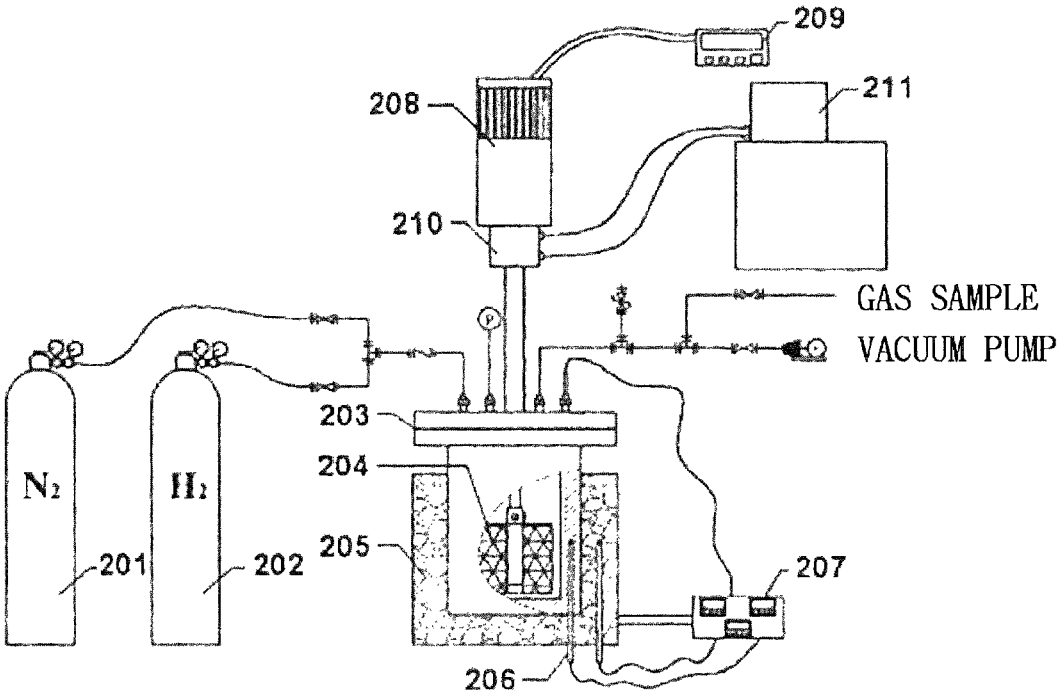
FIG. 4 is a schematic diagram showing a test apparatus, in accordance with an embodiment of the invention.

Tests were carried out in a laboratory-scale batch reactor (which was designed to endure 873 K and 40 MPa). FIG. 4 is a schematic diagram showing an apparatus used in the tests, in accordance with an embodiment of the invention.

In the test apparatus, a reactor 203 (volume capacity: 200 mL) was made of a nickel-based alloy (INCONEL® 625) in order to prevent the reactor 203 from being corroded by sulfur at high temperature. A check valve (not shown) was provided in a gas supply line in order to prevent a medium from flowing backward from a high-pressure reactor. An electric heater 206 (heating rate: about 30° C./min) was used as a heater. In order to prevent thermal loss to the outside, the electric heater 206 and the reactor 203 were covered with an insulator (not shown). K-type thermoelectric couples (not shown) are disposed at three positions (center of reactor, inner wall of reactor, and surface of reactor between reactor and electric heater) of a system. The temperature of the reactor 203 was measured by the thermoelectric couple (not shown) located at the middle of the reactor 203, and was controlled in the range of ±2.5° C. by a PID temperature controller 207. Reaction pressure was measured by a pressure gauge and a pressure transducer.

In accordance with various embodiments, a catalyst was charged in four spinning baskets 204 provided on an impeller shaft to support the catalyst, and thus the catalyst is in contact with a solution without being damaged by the stirring of an impeller. The stirring speed is adjusted by controlling a high-pressure stirrer 208 using a stirring speed controller 209. The overheating of high-pressure stirrer 208 is prevented using a stirrer cooler 210 and a cooling bath 211.

In accordance with at least one embodiment, 5 g of a vacuum residue and a solvent were mixed while being ultrasonically treated for about 10 minutes, and the mixing ratio of solvent:vacuum residue was 8:1. The mixture was introduced into the reactor 203, and then 8 g of the catalyst was uniformly introduced into the four spinning baskets 204. The reactor 203 was purged with nitrogen gas using a nitrogen cylinder 201 to remove air from the reactor 203, and then made vacuous rapidly. When the reaction temperature reached a target reaction temperature, hydrogen gas was rapidly supplied from a hydrogen cylinder 202 to the reactor 203 by a high pressure controller. After the reaction temperature reached the target reaction temperature at a stirring speed of 400~600 ppm, a reaction was conducted at a predetermined temperature for 30 minutes.

After the reaction, the electric heater 204 was removed from the reactor 203, and then rapidly cooled to room temperature using water. Then, each spinning basket 204 connected to the impeller shaft was lifted up to the gas phase in the reactor 203, and was rotated at a rotation speed of 800 rpm for 5 hours (centrifugal separation).

Figure 5:
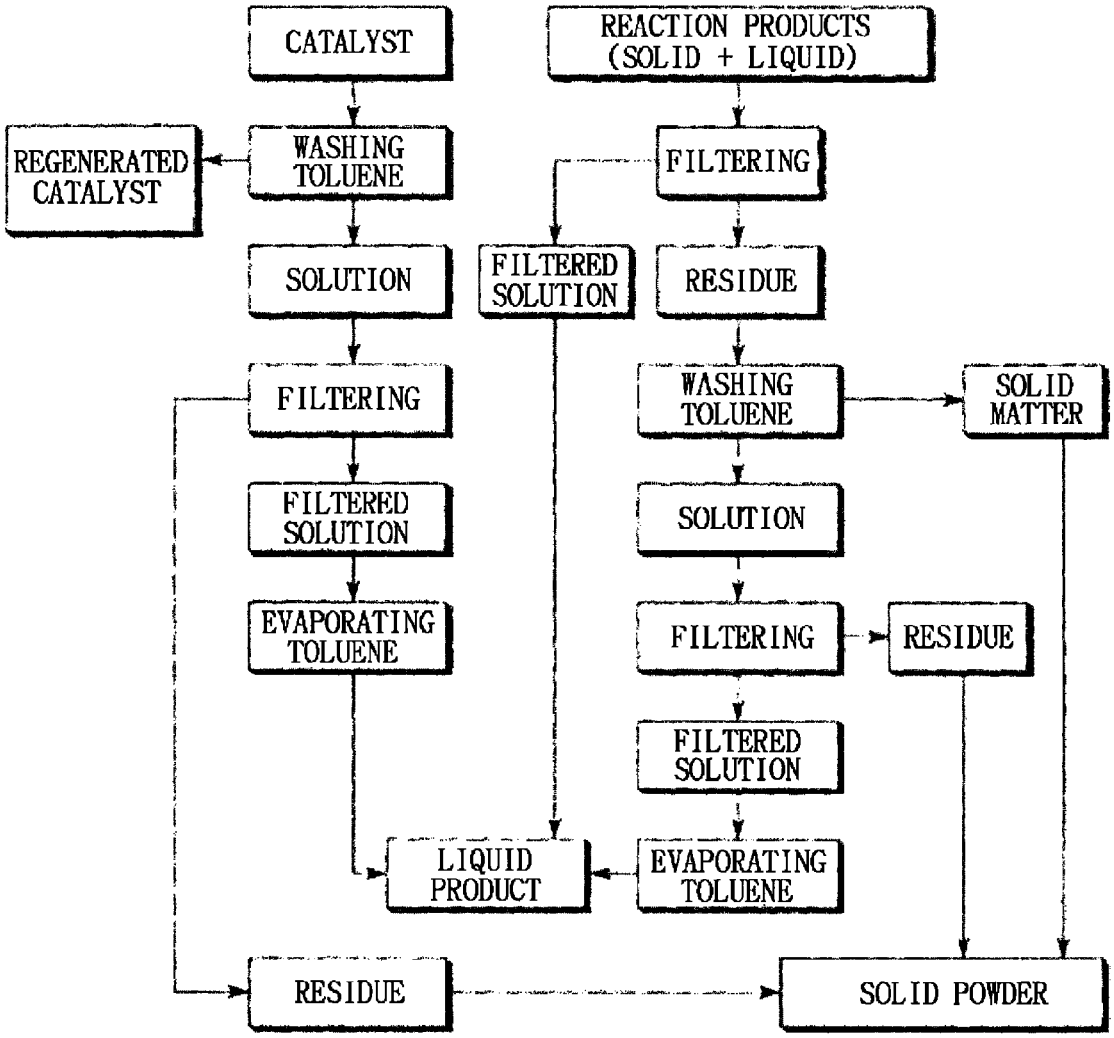
FIG. 5 is a schematic diagram showing a sampling procedure for recovering a sample from a catalyst and a liquid reaction product obtained by a hydrocracking reaction of a vacuum residue, in accordance with an embodiment of the invention.
Figure 6A:
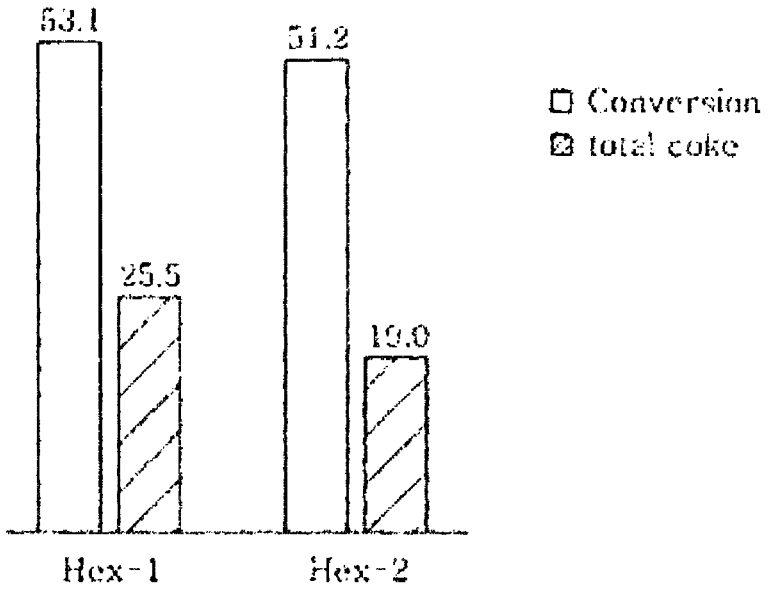
FIGS. 6A and 6B illustrate results (conversion ratio, total coke amount and reaction product distribution) of a hydrocracking reaction (about 400° C., 3.45 MPa) of a vacuum residue using supercritical n-hexane as a medium, in accordance with an embodiment of the invention.
Figure 6B:
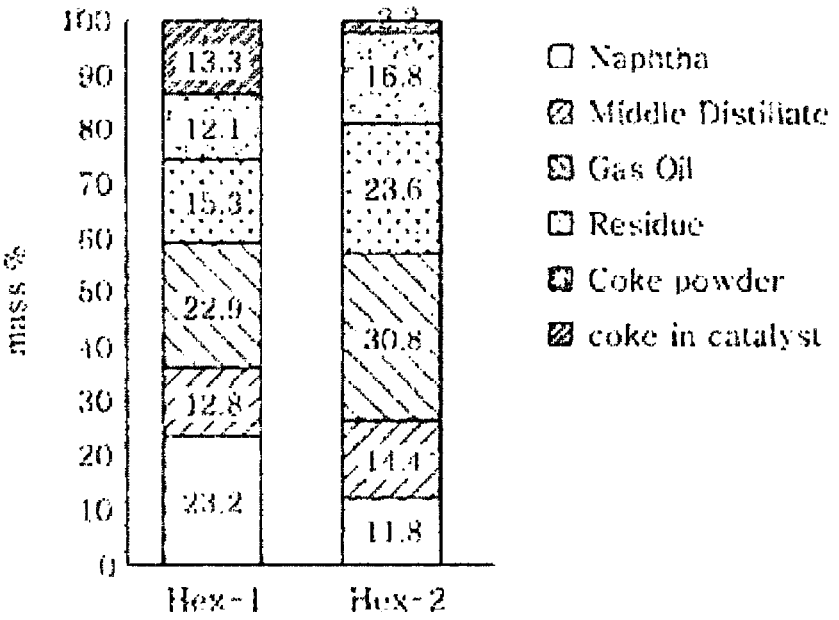
Figure 7A:
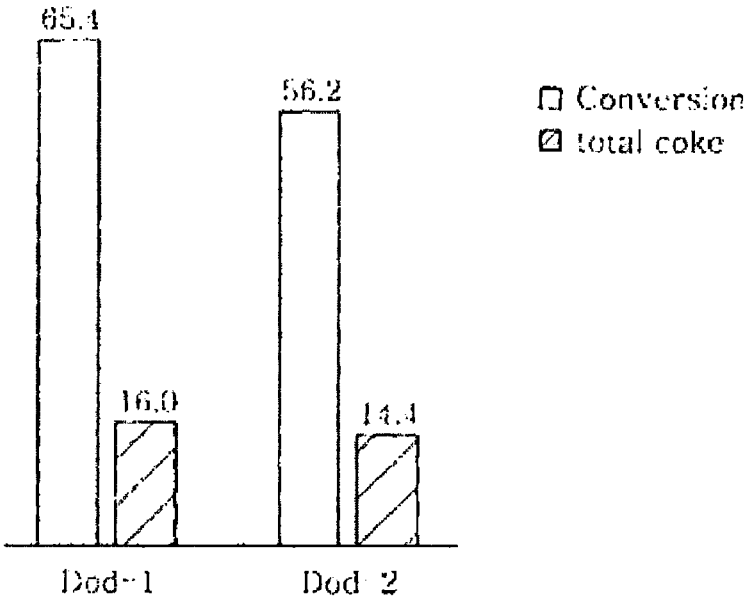
FIGS. 7A and 7B illustrate results (conversion ratio, total coke amount and reaction product distribution) of a hydrocracking reaction (about 400° C., 3.45 MPa) of a vacuum residue using supercritical n-dodecane as a medium, in accordance with an embodiment of the invention.
Figure 7B:
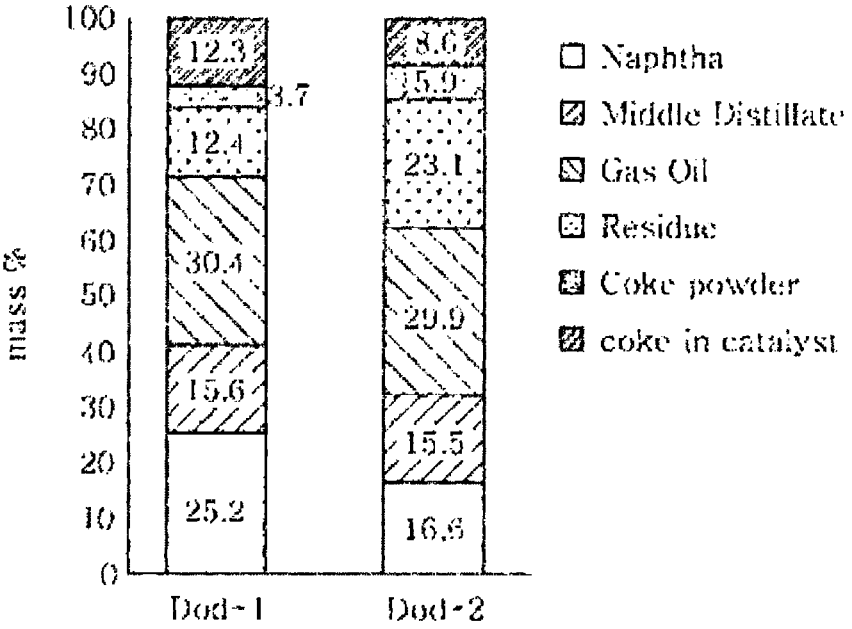
Figure 8A:
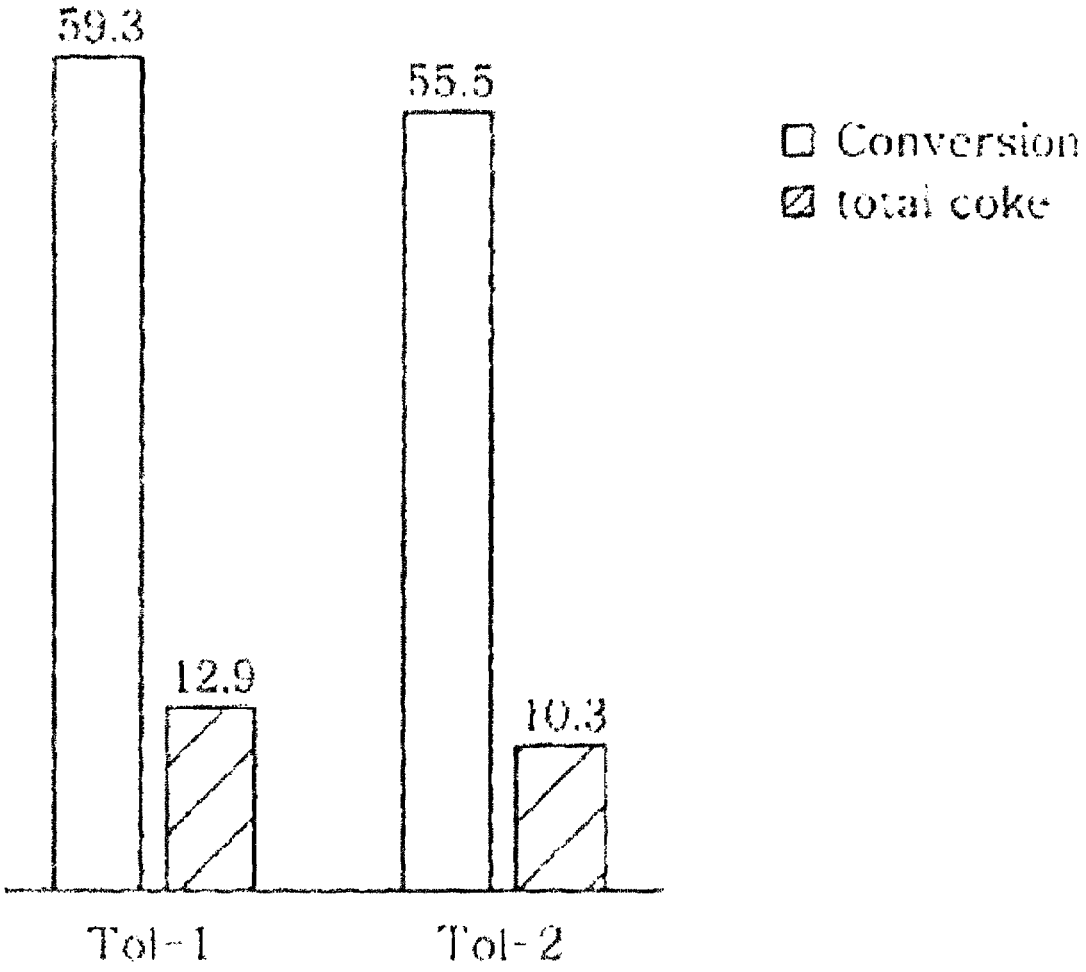
FIGS. 8A and 8B illustrate results (conversion ratio, total coke amount and reaction product distribution) of a hydrocracking reaction (about 400° C., 3.45 MPa) of a vacuum residue using supercritical toluene as a medium, in accordance with an embodiment of the invention.
Figure 8B:
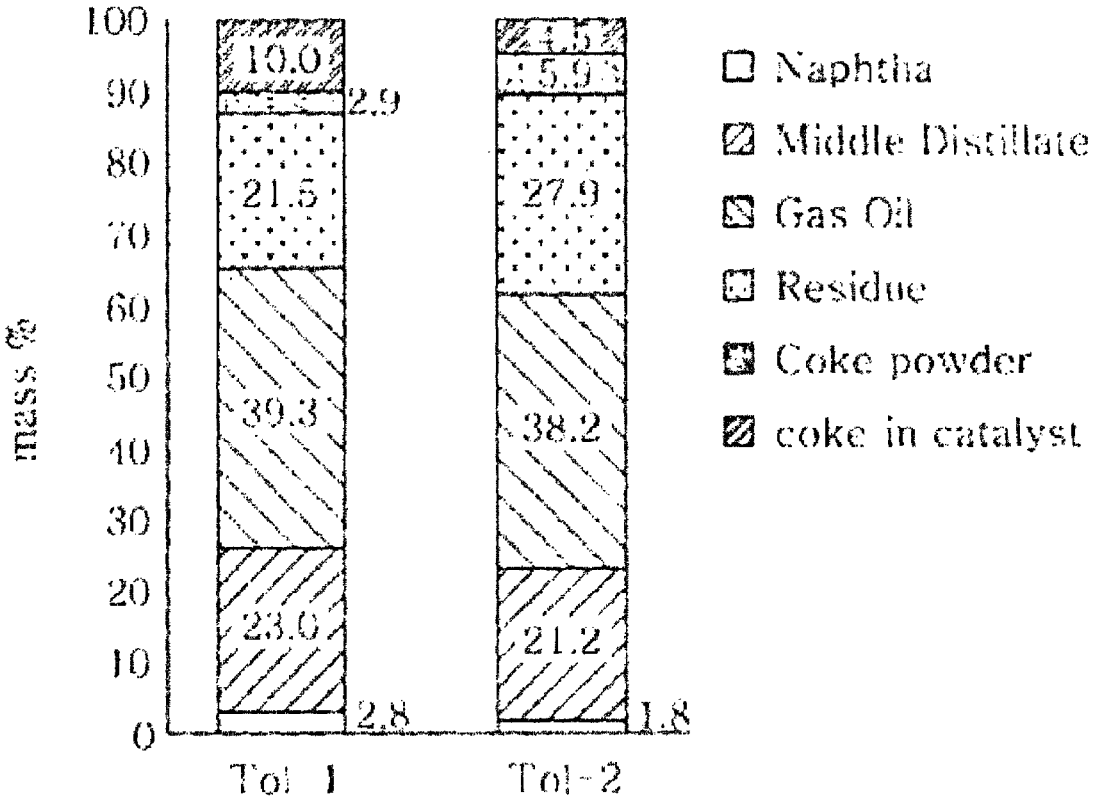
Figure 9A:
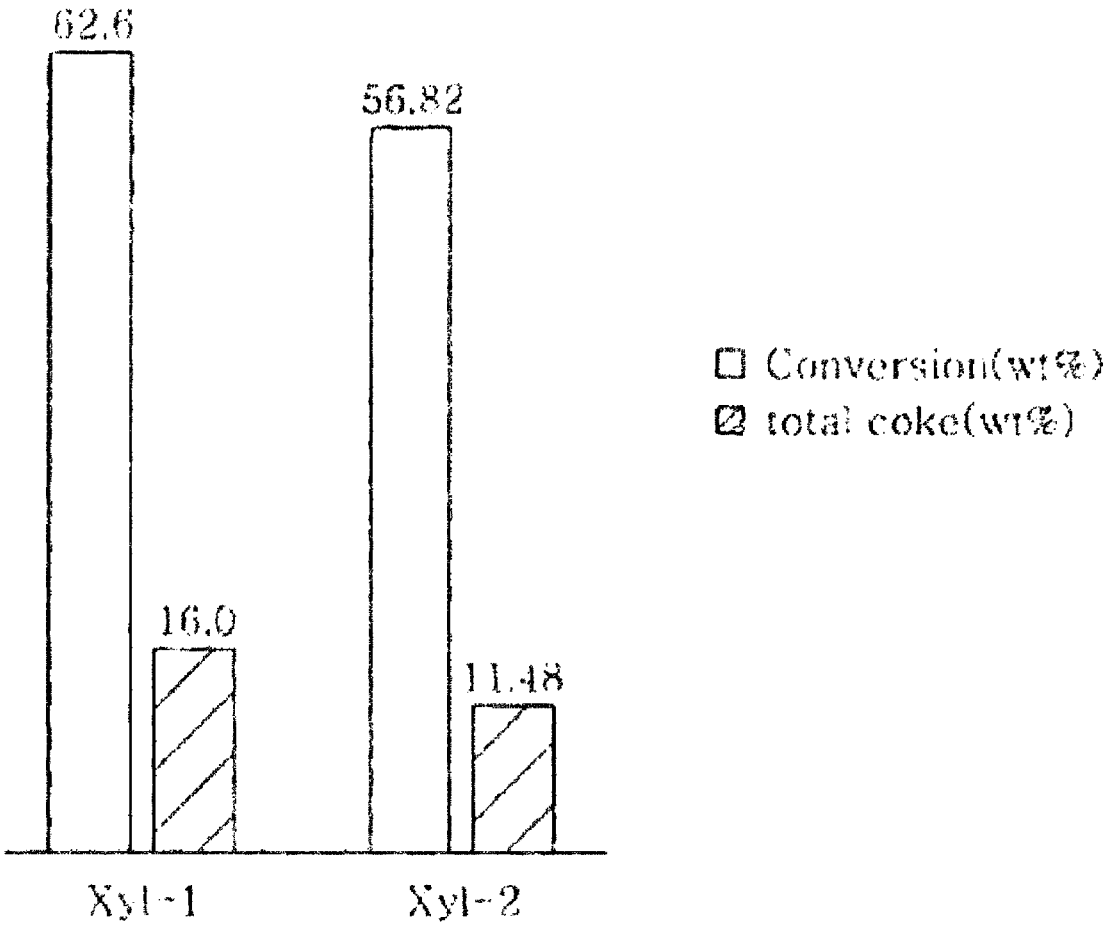
FIGS. 9A and 9B illustrate results (conversion ratio, total coke amount and reaction product distribution) of a hydrocracking reaction (about 400° C., hydrogen partial pressure: 3.45 MPa) of a vacuum residue using supercritical m-xylene as a medium, in accordance with an embodiment of the invention.
Figure 9B:
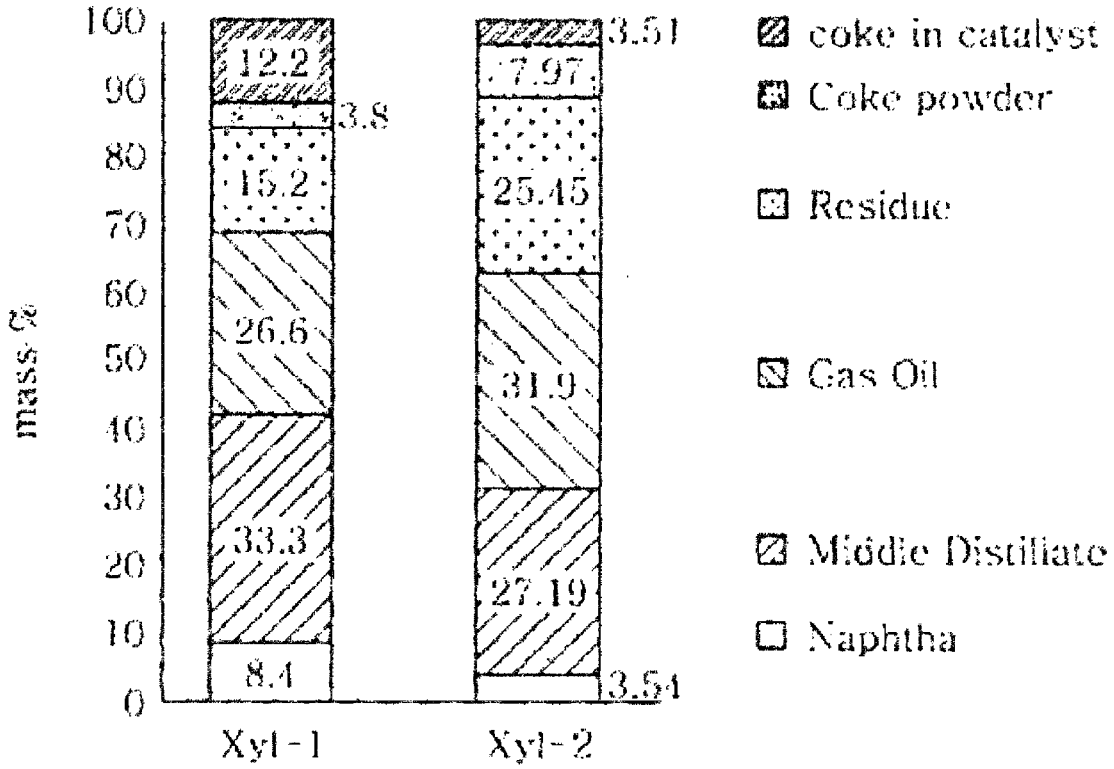

FIG. 5 shows a schematic diagram showing a sampling procedure for recovering a sample from a catalyst and a liquid reaction product obtained by a hydrocracking reaction of a vacuum residue, in accordance with an embodiment of the invention.

A reaction solution was filtered by a glass fiber filter (grade GF/F, WHATMAN®) under vacuum, and the filtered solid matter and catalyst were washed with toluene by the Soxhlet method. An extraction solution was recovered and then evaporated at 100° C. under reduced pressure, and an oil residue was mixed with a liquid reaction product. The washed solid matter and catalyst was dried at 140° C. for 2 to 3 hours under a nitrogen gas atmosphere. In Example 1, the dried solid matter is designated by "coke powder" (i.e., coke particles floating in the liquid reaction product), and the amount of coke deposited in the active carbon catalyst (i.e., the amount of coke in catalyst) was calculated by measuring the weight of the dried catalyst.

The liquid reaction product was analyzed by simulated distillation (SIMDIS) gas chromatography at high temperature according to the ASTM 7213A-7890 method. In this case, oil products were classified into four groups of naphtha (IBP to 177° C.), a middle distillate (177 to 343° C.), vacuum gas oil (343 to 525° C.) and a residue (525° C. or higher). In order to remove a solvent from the oil products, the boiling point distribution of a pure solvent was obtained.

The amount of coke and oil products was designated by wt % based on the weight of a vacuum residue (VR) as a feed. The yields (wt %) of naphtha, middle distillate, vacuum gas oil, residue, coke powder and coke in the catalyst were respectively calculated by the following Formulae (1) to (7).

$$\text{naptha(wt \%)} = \frac{\text{weight of naptha fraction}}{\text{weight of feed } VR} \times 100\% \quad (1)$$

$$\text{middle distillate(wt \%)} = \frac{\text{weight of middle distillate fracton}}{\text{weight of feed } VR} \times 100\% \quad (2)$$

$$\text{vacuum gas oil (wt \%)} = \frac{\text{weight of vacuum gas oil fraction}}{\text{weight of feed } VR} \times 100\% \quad (3)$$

$$\text{residue (wt \%)} = \frac{\text{weight of residue fraction}}{\text{weight of feed } VR} \times 100\% \quad (4)$$

$$\text{coke powder (wt \%)} = \frac{\text{weight of coke powder}}{\text{weight of feed } VR} \times 100\% \quad (5)$$

$$\text{coke in catalyst (wt \%)} = \frac{\text{weight of coke in catalyst}}{\text{weight of feed } VR} \times 100\% \quad (6)$$

$$\text{Total coke (wt \%)} = \text{coke powder (wt \%)} + \text{coke in catalyst (wt \%)} \quad (7)$$

Further, total conversion ratio was calculated by the following Formula (8).

$$\text{Total conversion ratio (wt \%)} = \text{naptha (wt \%)} + \text{middle distillate (wt \%)} + \text{vacuum gas oil (wt)} - 5.8 \quad (8)$$

In this case, gas and coke was excluded from the calculation of total conversion. The reason for this is that gas and coke were considered as unnecessary side products.

The test was independently repeated under the same condition. Each of the experimental errors of the yields of the reaction products (e.g., naphtha, middle distillate, vacuum gas oil, residue, coke powder and coke in catalyst) and the conversion ratios thereof were in the range of 0.5 to 1.

Influences Depending on Kinds of Solvents (Media)

A vacuum residue was treated using each of the four solvents (e.g., n-hexane, n-dodecane, toluene and m-xylene) according to the above-mentioned procedures. The results thereof are shown in Table 5 below and FIGS. 6 to 9. Here, the catalyst A mentioned in Table 4 above, that is, granulous active carbon (bituminous coal-derived active carbon, CALGON FILTRASORB 300®) was used.

TABLE 5

| n-hexane | | | | | | |
|---|---|---|---|---|---|---|
| Sample name | Catalyst | Reaction temperature (° C.) | Hydrogen partial pressure (MPa) | Conversion ratio (wt %) | Coke powder (wt %) | Total coke (wt %) |
| Hex-1 | novel (fresh) active carbon | 399 | 3.45 | 53.1 | 12.1 | 25.5 |
| Hex-2 | Regenerated active carbon | 400 | 3.45 | 51.2 | 16.7 | 19.0 |

TABLE 6

| n-dodecane | | | | | | |
|---|---|---|---|---|---|---|
| Sample name | Catalyst | Reaction temperature (° C.) | Hydrogen partial pressure (MPa) | Conversion ratio (wt %) | Coke powder (wt %) | Total coke (wt %) |
| Dod-1 | novel (fresh) active carbon | 412 | 3.45 | 65.4 | 3.7 | 16.0 |
| Dod-2 | Regenerated active carbon | 399 | 3.45 | 56.2 | 5.9 | 14.4 |

TABLE 7

| toluene | | | | | | |
|---|---|---|---|---|---|---|
| Sample name | Catalyst | Reaction temperature (° C.) | Hydrogen partial pressure (MPa) | Conversion ratio (wt %) | Coke powder (wt %) | Total coke (wt %) |
| Tol-1 | novel (fresh) active carbon | 399 | 3.45 | 59.3 | 2.9 | 12.9 |
| Tol-2 | Regenerated active carbon | 401 | 3.45 | 55.5 | 5.9 | 103 |

TABLE 8

| m-xylene | | | | | | |
|---|---|---|---|---|---|---|
| Sample name | Catalyst | Reaction temperature (° C.) | Hydrogen partial pressure (MPa) | Conversion ratio (wt %) | Coke powder (wt %) | Total coke (wt %) |
| Xyl-1 | novel (fresh) active carbon | 399 | 3.45 | 62.6 | 3.78 | 16.0 |
| Xyl-2 | Regenerated active carbon | 400 | 3.45 | 56.8 | 7.97 | 11.48 |

In Example 1, when m-xylene having a large steric hindrance is used as a solvent, a high conversion ratio can be obtained compared to when toluene is used. This fact supports the above-mentioned description that the effects of steric hindrance and hydrodynamic resistance under a supercritical condition are not important factors to be considered. Particularly, it is determined that m-xylene (including a benzene ring provided with two methyl groups) acts as a stronger hydrogen donor than toluene in the process of treating a vacuum residue under a supercritical condition.

As shown in FIGS. 6 to 9, it can be ascertained that, when m-xylene was used as a supercritical medium, a conversion ratio was remarkably high compared to when n-hexane or toluene was used. In contrast, when n-dodecane was used, the conversion ratio was equal or somewhat high compared to when m-xylene was used. However, comparing only the yields of naphtha and a middle distillate which are high value-added light distillates, when m-xylene was used, the yields thereof are equal to or higher than those obtained when n-dodecane was used.

Particularly, considering only a middle distillate that has recently experienced an increase in demand therefor, as shown in FIGS. 6 to 9, it can be ascertained that, when m-xylene was used, the conversion ratio of a vacuum residue into a middle distillate was remarkably high compared to when the three solvents were used.

When m-xylene was used, the amount of coke powder and the total amount of coke were equal or low compared to when n-hexane and n-dodecane were used, but were somewhat high compared to when toluene was used.

However, considering the conversion ratio of a vacuum residue into a high value-added distillate and the yield of the high value-added distillate, it can be ascertained that, when m-xylene was used, they were improved compared to when another solvent was used.

Influences of Hydrogen Pressure

Figure 10:
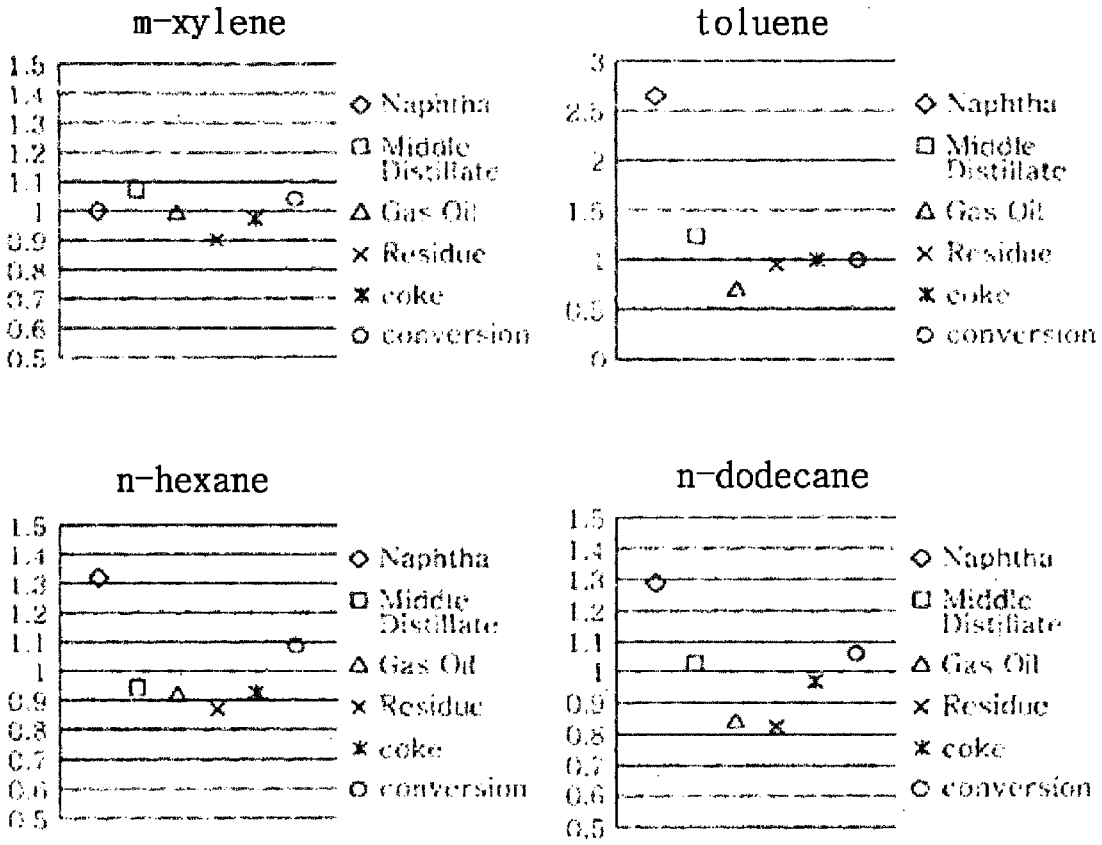
FIG. 10 shows graphs each showing a ratio of a content of distillates in a reaction product at low hydrogen pressure (3.45 MPa) to a content of distillate in a reaction product at high hydrogen pressure (6.89 MPa) with respect to each solvent under conditions of a reaction temperature of about 400° C. and an active carbon catalyst, in accordance with various embodiments of the invention.

In order to evaluate the influence of hydrogen pressure upon a reaction, the test was repeated while changing hydrogen partial pressure in the range of 3.45 MPa to 6.89 MPa. FIG. 10 shows the ratio of the content of distillates in the reaction product at high hydrogen pressure (6.89 MPa) to the content of distillates in the reaction product at low hydrogen pressure (3.45 MPa) with respect to each solvent used.

As shown in FIG. 10, when m-xylene was used as a medium, the content (about 1 to 1.1) of high value-added distillates (that is, naphtha and a middle distillate) in the reaction product was not greatly influenced according to the increase in hydrogen pressure. This result means that the hydrogenation performance of a catalyst in the m-xylene medium was not greatly changed according to hydrogen pressure.

In contrast, when other solvents (e.g., toluene, n-dodecane and n-hexane) were used, the change in the content of naphtha and/or a middle distillate was remarkably increased according to the increase in hydrogen pressure. Specifically, it can be ascertained that, when toluene was used, the content of naphtha and/or a middle distillate are remarkably increased compared to when m-xylene was used. This result supports the fact that, when m-xylene is used, the yield of high value-added distillates (particularly, a middle distillate which is a raw material of diesel oil) can be increased by hydrotreatment even at low hydrogen pressure compared to when another solvent is used.

Influences of Surface Characteristics of Active Carbon

In order to evaluate the influence of acid treatment and active carbon type upon the hydrogenation reaction of a vacuum residue, the test was carried out in the same manner as the above test (solvent: m-xylene). The results thereof when a catalyst was not used and when catalysts A to D were used are shown in Table 9 below and FIG. 11.

TABLE 9

| No. | Catalyst | Reaction temperature (° C.) | Hydrogen partial pressure (MPa) | Coke powder (wt %) | Total coke (wt %) | Conversion (wt %) |
|---|---|---|---|---|---|---|
| 1 | — | 399 | 3.45 | 16.3 | 16.3 | 44.1 |
| 2 | A | 399 | 3.45 | 3.8 | 16.0 | 62.6 |
| 3 | B | 400 | 3.45 | 2.2 | 13.5 | 69.2 |
| 4 | C | 400 | 3.45 | 2.0 | 13.2 | 68.2 |
| 5 | D | 400 | 3.45 | 2.0 | 13.9 | 72.4 |

In this test, since reaction conditions are nearly the same, it can be seen that the difference in conversion ratio is caused by a catalyst. From Table 9 above, it can be ascertained that, when the catalysts A to D were used, the conversion ratio was increased compared to when a catalyst was not used.

The surface acidity of the catalyst C was similar to that of the catalyst A, and was far lower than that of the catalyst B. However, when the catalyst C was used, the conversion ratio (68.3 wt %) was high, and the coke formation rate (total coke: 13.2 wt %) low compared to when the catalyst A, whereas the performance of the catalyst C was lower than that of the catalyst B. Further, the catalyst D having the largest mesopore area and volume exhibited the highest conversion ratio (72.4 wt %), and exhibited a coke formation rate (13.9 wt %) similar to that of the catalyst B. These results demonstrate that surface acidity improves a conversion rate without relation to the type of active carbon. Further, it is inferred that the surface area and volume of mesopore function to improve a conversion ratio and to control the formation of coke.

Figure 11:
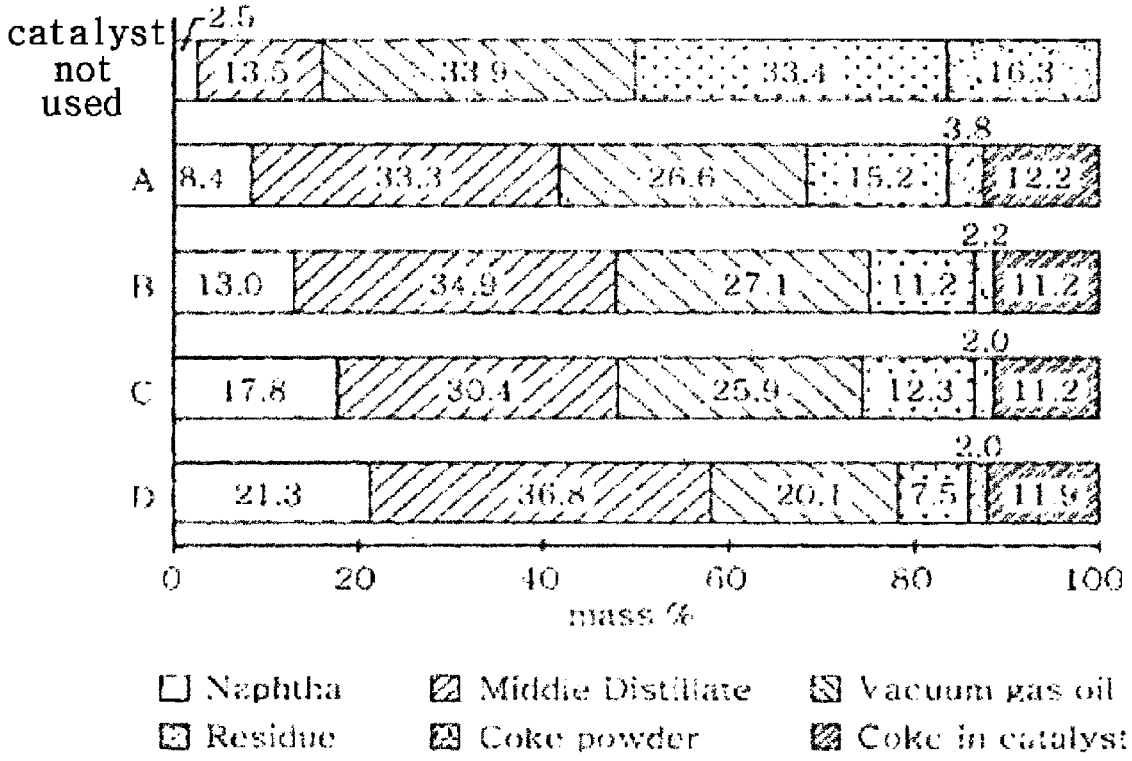
FIG. 11 is a graph showing distribution characteristics of reaction products when active carbon catalysts (catalysts A to D) were used and when the active carbon catalysts were not used, in the process for performing a hydrocracking reaction (about 400° C., hydrogen partial pressure: 3.45 MPa) of a vacuum residue using supercritical m-xylene as a medium, in accordance with an embodiment of the invention.

In relation to the properties of reaction products, as shown in FIG. 11, petroleum pitch-derived active carbon catalysts (catalysts C and D) were advantageous in terms of a conversion ratio of a heavy distillate into a light distillate and a yield of a light distillate. Although the catalyst C had low surface acidity, a small micropore diameter, and a small mesopore diameter compared to the catalyst A, the naphtha production (17.8 wt %) of the catalyst C was two times or more of the naphtha production (8.5 wt %) of the catalyst A. Particularly, the catalyst D reformed by acid treatment had a naphtha yield (13.0 wt/o) and a middle distillate yield (34.9 wt %) compared to the catalyst B although it had a small mesopore diameter. The production of a residue was inversely proportional to the mosopore area of active carbon (catalyst D>catalyst B>catalyst C>catalyst A).

In terms of coke formation, the coke formation rate of the catalyst A was low compared to when a catalyst was not used. Further, the acid-treated catalyst B reduced the coke formation rate. In the case of petroleum pitch-derived active carbon, although reformed active carbon is fine compared to non-reformed active carbon, it has a high coke formation rate. As a result, the catalyst C had the lowest coke formation rate. The sum of yield of naphtha of the catalyst C and yield of a middle distillate of the catalyst C was similar to that of the catalyst B, but the naphtha production of the catalyst C was higher than that of the catalyst B. From the results, it is inferred that asphaltene is reacted in mesopores to be decomposed, and the decomposed asphaltene can be more easily reacted in micropores. Further, it can be inferred that the steric hindrance in mesopores contributes to the improvement of a conversion ratio and the control of coke formation, and thus the production of a light distillate is increased due to micropores that are slightly poisoned by coke.

Influences of Metal Cocatalyst Components

In the hydrogenation reaction in a supercritical m-xylene medium, effects occurring when metal cocatalyst components are added to active carbon catalysts reformed by acid treatment (catalysts B and D) were evaluated. The results of evaluating the conversion ratio and coke formation rate according to the addition of 1 w % (based on the weight of active carbon catalyst) of metal cocatalyst components (reaction temperature: about 400° C., hydrogen partial pressure: 3.45 MPa) are shown in Table 10 below.

TABLE 10

| No. | Catalyst | Reaction temperature (° C.) | Hydrogen partial pressure (MPa) | Coke powder (wt %) | Total coke (wt %) | Conversion ratio (wt %) |
|---|---|---|---|---|---|---|
| 6 | 0.1% Li + catalyst B | 400 | 3.45 | 2.1 | 14.6 | 67.0 |
| 7 | 1% Li + catalyst B | 400 | 3.45 | 2.0 | 13.4 | 69.7 |
| 8 | 0.1% Ni + catalyst B | 400 | 3.45 | 1.9 | 14.5 | 68.6 |

TABLE 10-continued

| No. | Catalyst | Reaction temperature (° C.) | Hydrogen partial pressure (MPa) | Coke powder (wt %) | Total coke (wt %) | Conversion ratio (wt %) |
|---|---|---|---|---|---|---|
| 9 | 1% Ni + catalyst B | 400 | 3.45 | 2.0 | 14.0 | 70.0 |
| 10 | 0.1% Fe + catalyst B | 400 | 3.45 | 2.0 | 14.3 | 68.1 |
| 11 | 1% Fe + catalyst B | 400 | 3.45 | 2.0 | 13.4 | 71.0 |
| 12 | 10% Fe + catalyst B | 400 | 3.45 | 5.7 | 15.0 | 72.6 |
| 13 | 0.1% Li + catalyst D | 400 | 3.45 | 2.0 | 14.8 | 71.2 |
| 14 | 1% Li + catalyst D | 399 | 3.45 | 2.0 | 14.1 | 73.1 |
| 15 | 0.1% Ni + catalyst D | 400 | 3.45 | 2.0 | 14.5 | 71.3 |
| 16 | 1% Ni + catalyst D | 400 | 3.45 | 2.1 | 13.7 | 72.7 |
| 17 | 0.1% Fe + catalyst D | 400 | 3.45 | 2.0 | 14.7 | 71.1 |
| 18 | 1% Fe + catalyst D | 400 | 3.45 | 2.0 | 14.0 | 73.4 |
| 19 | 10% Fe + catalyst D | 400 | 3.45 | 5.6 | 12.5 | 74.9 |

As shown in Table 10 above, the conversion ratio was somewhat increased by the addition of a metal cocatalyst component, but the degree of improvement thereof was different according to the type of metal additive and active carbon. When 1 wt % of a metal cocatalyst was added to the catalyst B, the conversion ratio was increased from 69.2 wt % (No. 3, when the catalyst B did not include the metal cocatalyst) to 69.7 wt % (No. 7), 70.0 wt % (No. 9) and 71.0 wt % (No. 11). In contrast, the influence of the addition of a metal cocatalyst upon the catalyst D was relatively slight compared to the catalyst B. In the case of the catalyst D, the conversion ratio was somewhat increased from 72.4 wt % (when the catalyst D did not include the metal cocatalyst) to 73.1 wt % (No. 14), 72.7 wt % (No. 16) and 73.1 wt % (No. 18). However, in terms of coke formation, when the metal cocatalyst was added, the coke formation rate was similar to the coke formation rate when the metal cocatalyst was not added. Here, the coke formation rate was slightly increased except when Ni was added. From the results, it can be inferred that, when iron (Fe) was added, the effect of improvement of a conversion ratio was high compared to when another metal was added.

Figure 12A:
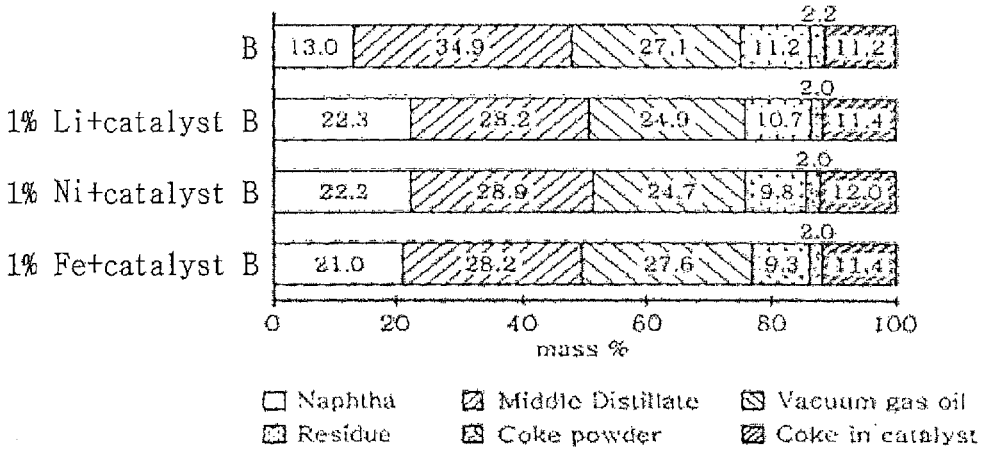
FIGS. 12A and 12B are graphs showing distribution characteristics of reaction products when acid-treated active carbon catalysts (catalysts B and D, respectively) were used and when each of the acid-treated active carbon catalysts was impregnated with 1 wt % of lithium (Li), 1 wt % of nickel (Ni) and 1 wt % of iron (Fe), each of which is a cocatalyst, in the process for performing a hydrocracking reaction (about 400° C., hydrogen partial pressure: 3.45 MPa) of a vacuum residue using supercritical m-xylene as a medium, in accordance with an embodiment of the invention.
Figure 12B:
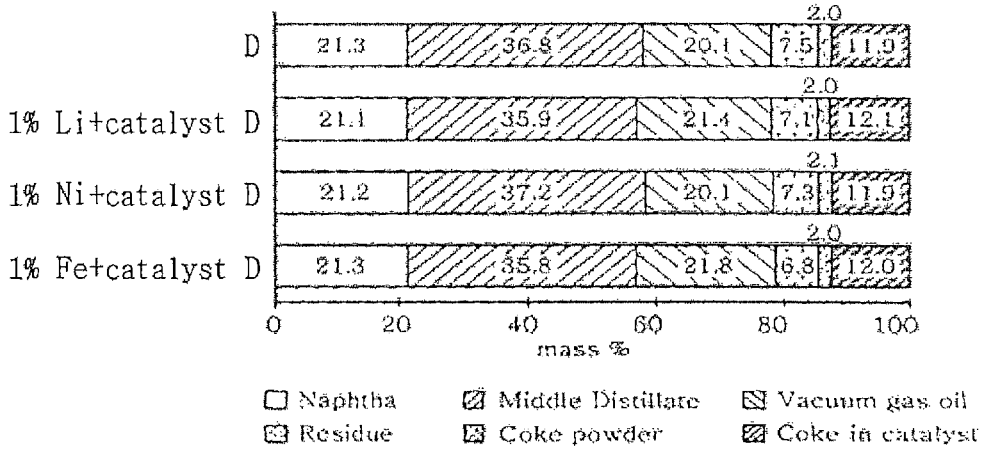

FIGS. 12A and 12B show distribution characteristics of reaction products according to three kinds of metal cocatalyst components. In particular, FIG. 12A shows the distribution characteristics of reaction products when metal cocatalyst components were added to the catalyst B, and FIG. 12B shows the distribution characteristics of reaction products when metal cocatalyst components were added to the catalyst D, in accordance with various embodiments of the invention. Comparing the yields of reaction products when metal cocatalyst components were added with those of reaction products when metal cocatalyst components were not added, naphtha was increased by the addition of metal cocatalyst components. Particularly, the yield of a middle distillate was decreased by the addition of metal cocatalyst components, demonstrating that the metal cocatalyst components contribute to the conversion of a middle distillate into naphtha to some degree. Further, the amount of coke powder was decreased from 2.2 wt % (i.e., when the metal cocatalyst component were not added) to 2.0 wt %, but the amount of coke in the catalyst was somewhat increased.

In the case of the catalyst D, as shown in FIG. 12B, the metal cocatalyst components did not influence the distribution of reaction products. This result suggests that, in the distribution of reaction products, the metal cocatalyst components have a greater influence on the hydrocracking reaction of a vacuum residue using a reformed bituminous coal-derived active carbon catalyst (catalyst B) under the condition of a supercritical m-xylene medium.

Influences Depending on the Contents of Metal Catalyst Components

Figure 13:
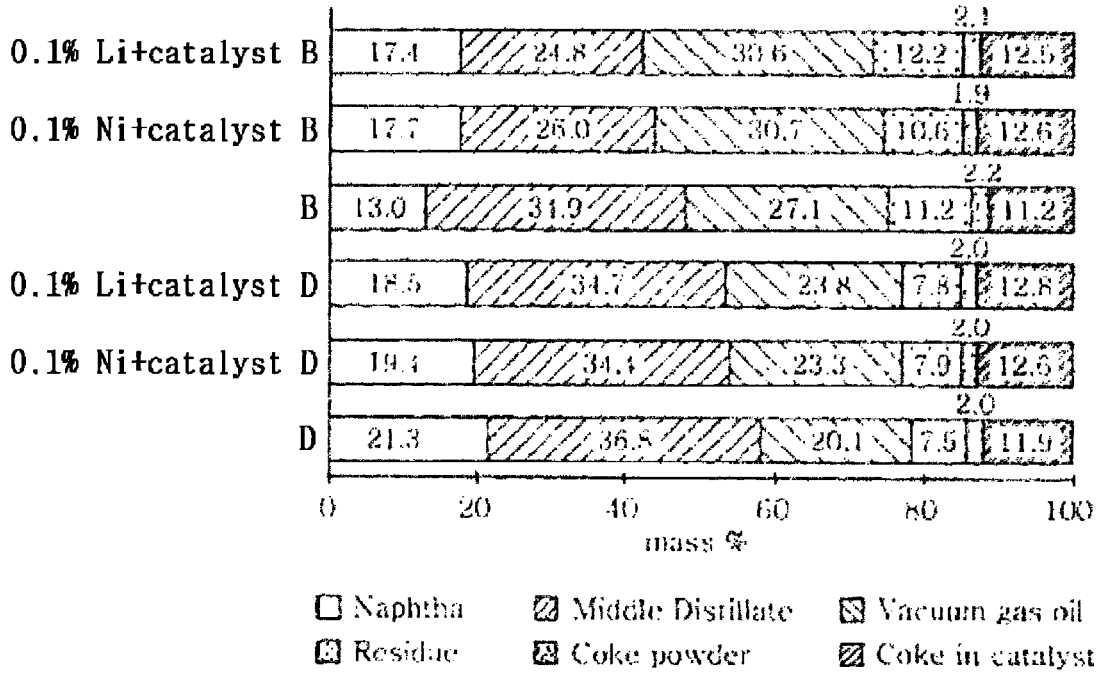
FIG. 13 is a graph showing distribution characteristics of reaction products when acid-treated active carbon catalysts (catalysts B and D) were used and when each of the acid-treated active carbon catalysts was impregnated with 0.1 wt % of lithium (Li) and 0.1 wt % of nickel (Ni), each of which is a cocatalyst, in the process for performing a hydrocracking reaction (about 400° C., hydrogen partial pressure: 3.45 MPa) of a vacuum residue using supercritical m-xylene as a medium, in accordance with an embodiment of the invention.
Figure 14:
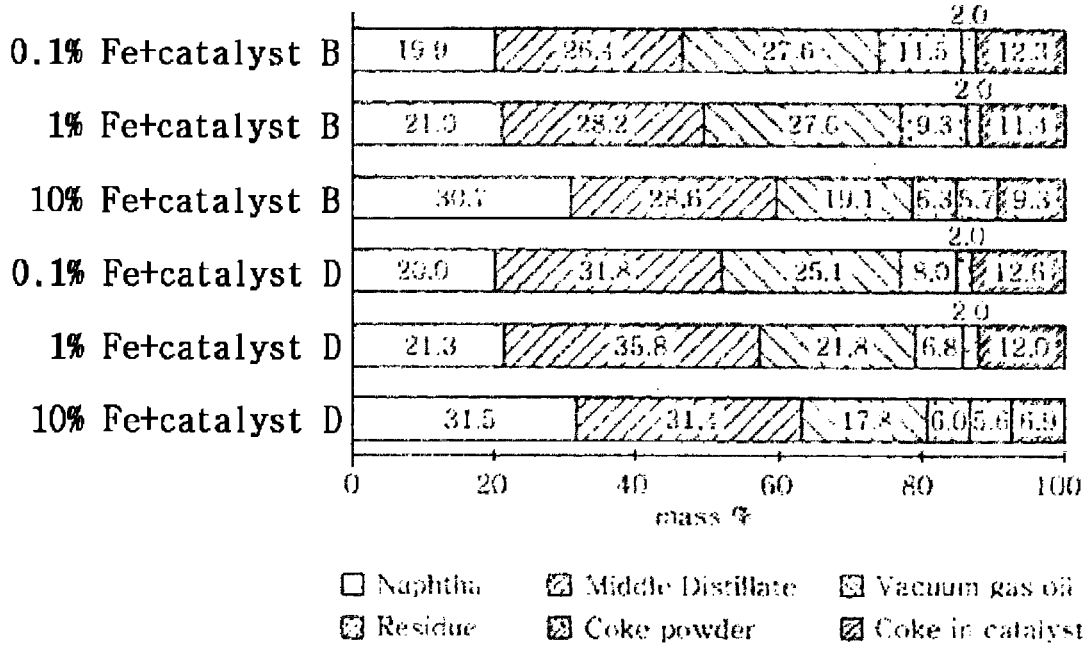
FIG. 14 is a graph showing distribution characteristics of reaction products when acid-treated active carbon catalysts (catalysts B and D) were used and when the acid-treated active carbon catalysts was impregnated with 0.1 wt % of iron (Fe), 1 wt % of iron (Fe) and 10 wt % of iron (Fe) each of which is a cocatalyst, respectively, in the process for performing a hydrocracking reaction (about 400° C., hydrogen partial pressure: 3.45 MPa) of a vacuum residue using supercritical m-xylene as a medium, in accordance with an embodiment of the invention.

FIGS. 13 and 14 show distribution characteristics of reaction products obtained by the hydrocracking of a vacuum residue depending on the contents of metal catalyst components (Li, Ni and Fe) under the conditions given in Table 10 above, in accordance with various embodiments of the invention.

When the content of the metal cocatalyst component was 0.1 wt %, the conversion ratio was somewhat decreased, whereas the coke formation rate was increased. In contrast, when the content thereof was 1 wt %, the result thereof was contrary to those when the content of the metal cocatalyst component was 0.1 wt %.

When 1 wt % of iron was used as a metal cocatalyst component, the most preferable result can be obtained compared to when another metal cocatalyst component was used. Particularly, when the content of iron was 10 wt %, the conversion ratio was additionally increased by 1.5 to 1.6 wt % compared to when the content thereof was 1 wt %. In contrast, in terms of coke formation, the coke formation rate was decreased when a petroleum pitch-derived active carbon was used, but was increased when a bituminous coal-derived active carbon was used.

FIG. 13 shows the distributions of reaction products when 0.1 wt % of Li or Ni was used.

As shown in FIG. 13, when a cocatalyst was added to a bituminous coal-derived active carbon catalyst (catalyst B), the production of naphtha was increased, whereas the production of a middle distillate was decreased. This result coincides with that of FIG. 12A. However, the production of a vacuum gas oil distillate and the production of coke in catalyst were increased, unlike in FIG. 12A in which 1 wt % of the cocatalyst was used. From the results, it can be inferred that the cocatalyst contributes to the hydrocracking of a middle distillate into naphtha when Li or Ni was added in a predetermined amount or less, but causes the precipitation of coke on a catalyst, thereby lowering catalytic activity.

Comparing the bituminous coal-derived active carbon catalyst (catalyst B) with a petroleum pitch-derived active carbon catalyst (catalyst D) containing no cocatalyst, the production of naphtha and a middle distillate was somewhat decreased, whereas the production of relatively heavy distillates such as vacuum gas oil, a vacuum residue and coke in catalyst was somewhat increased (that is, the values of reaction products can be lowered at low concentration). As shown in FIGS. 12B and 13, it is inferred that the petroleum pitch-derived active carbon catalyst is easily poisoned by coke compared to the bituminous coal-derived active carbon catalyst.

From the results of FIGS. 13 and 14, when a small amount (e.g., 0.1 wt %) of a cocatalyst is added during a hydrocracking reaction using a supercritical m-xylene medium, metal sites for the hydrocracking reaction cannot be sufficiently provided, so the proportion of light distillates (e.g., naphtha and a middle distillate) can be decreased, and the proportion of heavy distillates (e.g., vacuum gas oil and a vacuum residue) can be increased.

In contrast, as shown in FIG. 14, it can be seen that, when iron (Fe) was added in a relatively large amount (e.g., 10 wt %), high product quality (yield of light distillates) as well as a high conversion ratio was obtained. Specifically, referring to Table 10 above, it can be ascertained that catalysts including 10 wt % of iron (Fe) can obtain a remarkable conversion ratio improvement effect compared to the catalysts B and D (No. 3 and 5) including no iron (Fe). Further, the degree of conversion ratio improvement of the catalysts including 10 wt % of iron (Fe) is higher than that of the conversion ratio improvement of the catalysts including 1 wt % of iron (Fe). In addition, when the content of iron (Fe) was high, the production of light distillates was increased, and, comparing FIG. 11 with FIG. 14, the production of coke in catalyst was decreased, whereas the production of coke powder was increased. Particularly, when the catalyst D having high content of iron (Fe) was used, the total production of coke was remarkably decreased compared to when the catalyst D including no cocatalyst was used. These results demonstrate that the catalyst obtained by adding 10 wt % of iron (Fe) to acid-treated active carbon in a supercritical m-xylene medium is advantageous in terms of a conversion ratio and production of light distillates.

As described above, in the hydrotreatment of heavy hydrocarbon distillates in a supercritical medium, when a xylene-containing solvent is used, selectivity of high value-added distillates, particularly, a middle distillate and a conversion ratio can be improved. In particular, because xylene has a relatively low boiling point, it is more advantageous when it is applied to commercially used processes. In addition, the conversion ratio can be improved using an active carbon catalyst surface-modified by acid treatment as a catalyst. Moreover, when a metal cocatalyst component is added to the catalyst, the conversion ratio can be improved, the formation of coke can be reduced, the catalyst poisoning caused by coke can be reduced, and, if necessary, the yield of reaction products, particularly, a light distillate can be changed.

Embodiments of the invention provide non-obvious advantages over conventional hydrocracking process. For example, various embodiments provide a hydrocracking process for converting low value-added heavy hydrocarbon distillates into high value-added hydrocarbon distillates using a supercritical solvent as a medium. The hydrocracking process, according to various embodiments increases the recovery rate of high value-added hydrocarbon distillates, particularly a middle distillate (e.g., a raw material of diesel oil), by using a xylene-containing solvent. The yield of high value-added hydrocarbon distillates (e.g., middle distillate and naphtha) can be adjusted depending on a catalyst that is used. Further, the hydrocracking process, according to various embodiments of the invention, demonstrate that low value-added heavy hydrocarbon distillates can be effectively converted into high value-added heavy hydrocarbon distillates even under low hydrogen pressure conditions, and therefore provides man.

Although the embodiments of the present invention have been disclosed for illustrative purposes, it will be appreciated that the present invention is not limited thereto, and those skilled in the art will appreciate that various modifications, additions and substitutions are possible, without departing from the scope and spirit of the invention. Accordingly, any and all modifications, variations or equivalent arrangements should be considered to be within the scope of the invention, and the detailed scope of the invention will be disclosed by the accompanying claims.

We claim:

1. A method of converting a heavy hydrocarbon distillate into a low-boiling hydrocarbon, the method comprising the step of:

contacting a heavy hydrocarbon distillate with a supercritical xylene-containing solvent in the presence of a hydrogenation catalyst to hydrogenate the heavy hydrocarbon distillate for converting the heavy hydrocarbon distillate into the low-boiling hydrocarbon, wherein the hydrogenation catalyst is a petroleum pitch-derived active carbon catalyst, wherein the supercritical xylene-containing solvent comprises at least 25 wt % of m-xylene, wherein the active carbon catalyst has a mesopore area of 100-400 $m^2/g$ and a mesopore volume of 0.15-0.4 $cm^3/g$, wherein the active carbon catalyst is an acid-treated active carbon catalyst, and wherein the total acidity of the acid-treated carbon catalyst is 0.1 to 3 meq/g.

2. The method of claim 1, wherein the hydrogenation of the heavy hydrocarbon distillate is performed at a hydrogen pressure of 30 to 150 bars.

3. The method of claim 1, wherein the supercritical xylene-containing solvent comprises (i) 70 to 85 wt % of xylene, (ii) 15 to 25 wt % of ethylbenzene, and (iii) 5 wt % of toluene or a $C_9$+ aromatic.

4. The method of claim 1, wherein the heavy hydrocarbon distillate is a vacuum residue.

5. The method of claim 1, wherein a weight ratio of the supercritical xylene-containing solvent to the heavy hydrocarbon distillate (xylene-containing solvent/heavy hydrocarbon distillate) is 3 to 10.

6. The method of claim 1, wherein the hydrogenation of the heavy hydrocarbon distillate is performed at a temperature of 350° C. to 420° C. and a hydrogen pressure of 30 to 100 bars.

7. The method of claim 1, wherein the acid-treated active carbon catalyst comprises sulfuric acid.

8. The method of claim 1, wherein the active carbon catalyst comprises 0.1 to 30 wt % of a cocatalyst containing at least one metal selected from the group consisting of IA group metals, VIIB group metals, and VIII group metals.

9. The method of claim 8, wherein the at least one metal included in the cocatalyst is lithium (Li), nickel (Ni), iron (Fe), or a combination thereof.

10. The method of claim 9, wherein the active carbon catalyst comprises 5 to 15 wt % of the cocatalyst.

11. The method of claim 1, wherein the hydrogenation of the heavy hydrocarbon distillate is performed in a fixed-bed reactor, an ebullating reactor or a slurry reactor.

12. The method of claim 1, wherein the low-boiling hydrocarbon comprises a middle distillate.

13. A method of converting a heavy hydrocarbon distillate into a low-boiling hydrocarbon, the method comprising the steps of:

a) introducing a heavy hydrocarbon distillate into a reaction zone;

b) hydrogenating the heavy hydrocarbon distillate in the presence of a supercritical xylene-containing solvent and a petroleum pitch-derived active carbon catalyst to obtain a hydrogenation reaction product, wherein the active carbon catalyst has a mesopore area of 100-400 $m^2/g$ and a mesopore volume of 0.15-0.4 $cm^3/g$, wherein the active carbon catalyst is an acid-treated active carbon catalyst, and wherein the total acidity of the acid-treated carbon catalyst is 0.1 to 3 meq/g;

c) transferring the hydrogenation reaction product to a fractionator to separate and recover a low-boiling target hydrocarbon distillate;

transferring non-separated and non-recovered components from the fractionator to an extractor to separate these components into recycle components and discharge components; and e) transferring the recycle components to the reaction zone, wherein the xylene-containing solvent comprises at least 25 wt % of m-xylene, the hydrogenation of the heavy hydrocarbon distillate is performed at a hydrogen pressure of 30 to 150 bars, and the recycle components comprise xylene.

14. The method of claim 13, wherein the discharge components comprise coke and a waste catalyst.

15. The method of claim 14, further comprising the steps of:

regenerating the waste catalyst; and recycling a portion of the regenerated waste catalyst for the hydrogenating step.

* * * * *